US006599037B1

(12) United States Patent
Transvalidou et al.

(10) Patent No.: US 6,599,037 B1
(45) Date of Patent: Jul. 29, 2003

(54) ULTRASONIC CLEANING IN BATCH PHOTOPROCESSING EQUIPMENT

(75) Inventors: Faye Transvalidou, Rochester, NY (US); Patrick M. Reed, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/218,807

(22) Filed: Aug. 14, 2002

(51) Int. Cl.[7] ..... G03D 3/02
(52) U.S. Cl. ..... 396/626; 396/635; 134/64 P
(58) Field of Search ..... 396/617, 620, 396/625, 626, 633–635; 134/56 R, 64 P, 64 R, 122 P; 355/27–29

(56) References Cited

U.S. PATENT DOCUMENTS 3,792,651 A 2/1974 Banks
4,005,463 A 1/1977 Kowalski
4,178,088 A 12/1979 Harding
4,269,501 A 5/1981 Griffith et al.
4,431,294 A 2/1984 Baker
4,650,308 A * 3/1987 Burbury ..... 396/626
4,736,221 A * 4/1988 Shidara ..... 134/64 P
5,799,224 A * 8/1998 Verlinden et al. ..... 396/636

* cited by examiner

*Primary Examiner*—D Rutledge
(74) *Attorney, Agent, or Firm*—David A. Novais

(57) ABSTRACT

A photographic processor includes a cleaning arrangement which comprises a transducer and an ultrasonic probe. In the system and method of the present invention, a cleaning cycle can be automatically initiated in a batch photographic processor. The automatic cleaning cycle involves the selected control of the transducer and the ultrasonic probe so as to place the probe in contact with cleaning solution in the processor, and the application of ultrasonic energy to the cleaning solution. In order to enhance the cleaning operation during a cleaning cycle, a circular processing drum of the photographic processor can be rotated slowly or intermittently to allow enough cleaning energy to be delivered to various components of the photographic processor.

23 Claims, 25 Drawing Sheets

ULTRASONIC CLEANING IN BATCH PHOTOPROCESSING EQUIPMENT

CROSS REFERENCE TO RELATED APPLICATIONS

The present application is related to the following pending patent applications: U.S. patent application Ser. No. 10/027,382 filed Dec. 21, 2001, entitled PHOTOGRAPHIC PROCESSOR AND METHOD OF OPERATION; U.S. patent application Ser. No. 10/027,454 filed Dec. 21, 2001, entitled A PROCESSING SOLUTION DELIVERY SYSTEM HAVING A SUPPLY TUBE AND LEVEL DETECTION SENSOR UNIT FOR USE WITH A PHOTOGRAPHIC PROCESSOR; U.S. patent application Ser. No. 10/027,381 filed Dec. 21, 2001, entitled PHOTOGRAPHIC PROCESSOR HAVING AN ADJUSTABLE DRUM; U.S. patent application Ser. No. 10/027,432 filed Dec. 21, 2001, entitled CHEMICAL DELIVERY SYSTEM FOR USE WITH A PHOTOGRAPHIC PROCESSOR AND METHOD OF OPERATION; U.S. patent application Ser. No. 10/108,141 filed Mar. 27, 2002, entitled PHOTOGRAPHIC PROCESSOR HAVING SIDE BY SIDE PROCESSING PATHS AND METHOD OF OPERATION; U.S. patent application Ser. No. 10/164,067 entitled PROCESSING SOLUTION DELIVERY SYSTEM FOR USE WITH A PHOTOGRAPHIC PROCESSOR AND METHOD OF OPERATION and U.S. patent application Ser. No. 10/185,185 entitled THERMAL MANAGEMENT DRUM FOR A PHOTOGRAPHIC PROCESSOR.

FIELD OF THE INVENTION

The present invention relates to a system and method for automatically cleaning a single roll or batch processor by using ultrasonic energy.

BACKGROUND OF THE INVENTION

Photoprocessing equipment sold in the trade requires regular (daily, weekly and monthly) cleaning to maintain the quality of images. Continuous transport processors for silver halide based sensitized media typically include a series of tanks holding various solutions (e.g. developer, acid stop bath, bleach accelerator, bleach (oxidant), fix (silver removal), stabilizer, final rinses and water rinses) employed not necessarily in this order or combination. The sensitized media is transported through these solutions through a system of roller assemblies. With daily use, the tanks (although they may be replenished to remove some soils and maintain activity levels) develop soils. In the traditional consumer negative processes the soils (by-products) generated in each processing step are identifiable for someone knowledgeable in the field, and they are in general confined in the tank (step where they are produced) or in the subsequent step (as carried-over by the sensitized media). Some of the soils that are of interest to the photographic industry are listed here: developer tar (e.g. para-phenylenediamine polymerization and/or oxidation by-products), various salts (e.g. thiosulfate, chelated iron), various calcium, magnesium, and aluminum salts, silver salts of varying solubility, by-products of reactions happening in the sensitized media, or a result of the quality of the local water source and so on.

Other sources of soil in photographic processors include the following: fragments of gelatin or other hydrophilic colloids that may be removed from the photographic material during processing, fragments of overcoat layers, matte layers, anti-static layers, or magnetic recording layers that may be removed from the photographic material during processing, fragments of photographic material (for example skivings that remain after the cutting, slitting, chopping, or perforating of the photographic material during its manufacturing) that are released into the processor or processing solutions, and deposits of biogrowth that may contaminate processing solutions or processor surfaces that come in contact with processing solutions, including stabilizers, rinses, and washes. Regular cleaning is used to avoid quality or yield losses because of chemical contamination or physical damage to the sensitized media.

This problem is exacerbated in single roll or single use (batch) processors. These machines may encounter lower productivity (infrequent use). In this type of equipment small amounts of chemicals are used to process the sensitized media in a single container. The process may include a color forming step, as well as steps for silver removal and rinsing of the media that were described above, and even combinations/consolidations of steps. This type of equipment is desirable for its increased flexibility (can accommodate several of the standard silver halide process cycles e.g. C-41, E-6 etc. depending on the chemical supply provided), but that same flexibility increases the risk for cross-contamination when small amounts of fluid form deposits in the container. It may also lead to catastrophic failure during loading and/or unloading of the next roll of sensitized media on the soiled sticky surfaces.

SUMMARY OF THE INVENTION

The present invention provides for a photographic processor which includes an automated cleaning arrangement or member that cleans the components of the photographic processor in an efficient manner. That is, the present invention provides for a system and method that provides an automated cleaning cycle in a photographic processor, and more specifically, photographic processors in the form of batch (single roll) processors. The system and method of the present invention overcomes common soil problems in batch processors that results in image quality loss (contamination) or catastrophic failure (tear during loading of sensitized media).

The cleaning arrangement of the present invention includes a transducer and ultrasonic probe assembly that is integrated into the processor and generates ultrasonic energy in cleaning solution as necessary. The probe can be stationary or mobile. The cleaning cycle or stage of the photographic processor of the present invention can be activated on demand or in planned intervals and does not require operator time or operator handling of any chemicals. The cleaning arrangement of the present invention can further use recycled or replenished cleaning solution for higher efficiency. In the system and method of the present invention, the solution can be delivered at room temperature or can be preheated.

The cleaning arrangement of the present invention can also utilize a liquid level sensor to confirm the presence of adequate cleaning fluid in the photographic processor before the ultrasonic source is activated to avoid damaging a probe of the cleaning arrangement.

The present invention accordingly provides for a photographic processor that comprises a circular processing drum having a processing chamber therein for processing photographic film; a disk positioned inside the drum and having one or more sets of disk teeth along an outer perimeter of the disk, with the disk teeth being capable of interengaging with holes along an edge of photographic film to be processed to transport the photographic film along a film path in the processing drum; and a cleaning arrangement comprising a transducer and a probe, with the transducer and the probe being adapted to provide ultrasonic energy to a cleaning solution provided in the processing chamber during a cleaning stage of the photographic processor to clean components of the photographic processor.

The present invention also provides for a photographic processing apparatus for processing photographic material which comprises a processing chamber for processing photographic media; and a cleaning arrangement which comprises a transducer and a probe, with the transducer and the probe being adapted to impart ultrasonic energy to cleaning solution provided in the processing chamber during a cleaning stage of the photographic processing apparatus.

The present invention also provides for a method of operating a photographic processor to process photographic media which comprises the steps of inserting photographic media into a processing drum; supplying and discarding processing solution into and from the processing drum during a processing stage to process the photographic media; supplying a cleaning solution to the processing drum during a cleaning stage; contacting the cleaning solution with an ultrasonic probe; and selectively activating the ultrasonic probe in contact with the cleaning solution to impart ultrasonic energy to the cleaning solution and clean components of the photographic processor.

The present invention further provides for a method of cleaning a processing chamber of a photographic processor which comprises the steps of supplying a cleaning solution in the processing chamber; contacting the cleaning solution with an ultrasonic probe; and selectively activating the ultrasonic probe in contact with the cleaning solution to impart an ultrasonic energy to the cleaning solution and clean components of the photographic processor.

BRIEF DESCRIPTION OF THE DRAWINGS

The present invention is further described with reference to the appended figures, wherein.

DETAILED DESCRIPTION OF THE INVENTION

Figure 1:
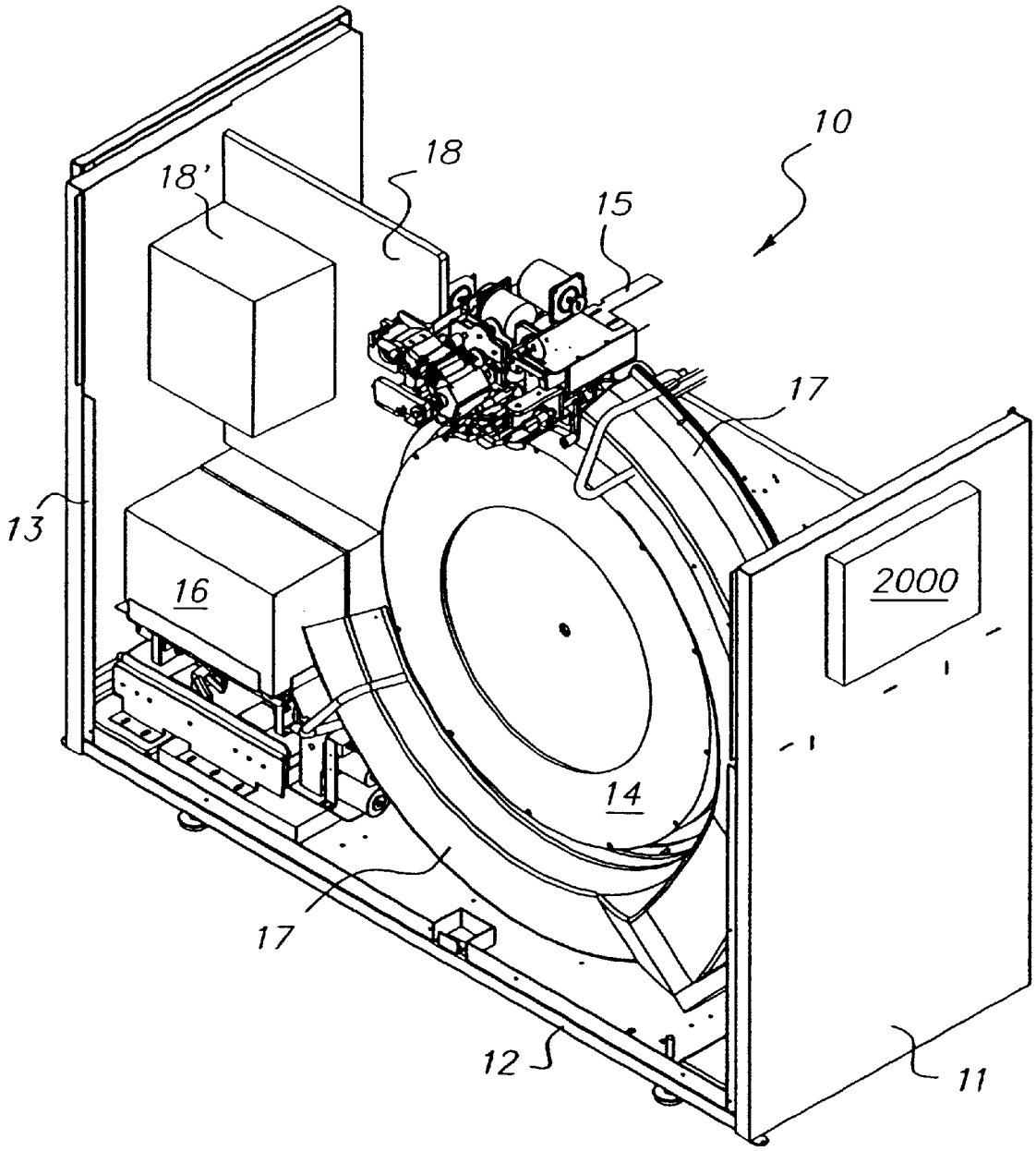
FIG. 1 is a frontal view of an exemplary a photographic processor.

An exemplary single roll (batch) photographic processor which can be used in the present invention is shown in FIG. 1 and described in co-pending application U.S. Ser. No. 10/027,382 (the subject matter of which is incorporated by reference). A photographic processor 10 comprises at least an outer housing, which includes a first side wall 11, a base housing member 12, and a second side wall 13. Photographic processor 10 includes a circular processing chamber or drum 14 (also referred to herein as the "circular processing drum 14"), which may be used to expose a given strip or roll of film to one or more photoprocessing chemicals. Photographic processor 10 further includes a film-loading/unloading device 15 positioned above and cooperating with circular processing drum 14. A chemical delivery system 16 is positioned for easy access by a user (i.e., for maintenance or replacement purposes) at a location near side wall 13 and base housing member 12. Photographic processor 10 also includes a circular dryer 17 in the form of, for example, a cylinder, for drying the processed film. Dryer 17 is concentrically and co-axially positioned around processing drum 14. Once a given strip or roll of film is dried in dryer 17, the film proceeds to a scanner 18', which may be positioned above chemical delivery system 16 in a space bordered by side wall 13 and left interior wall 18 or any other convenient location.

Figure 2:
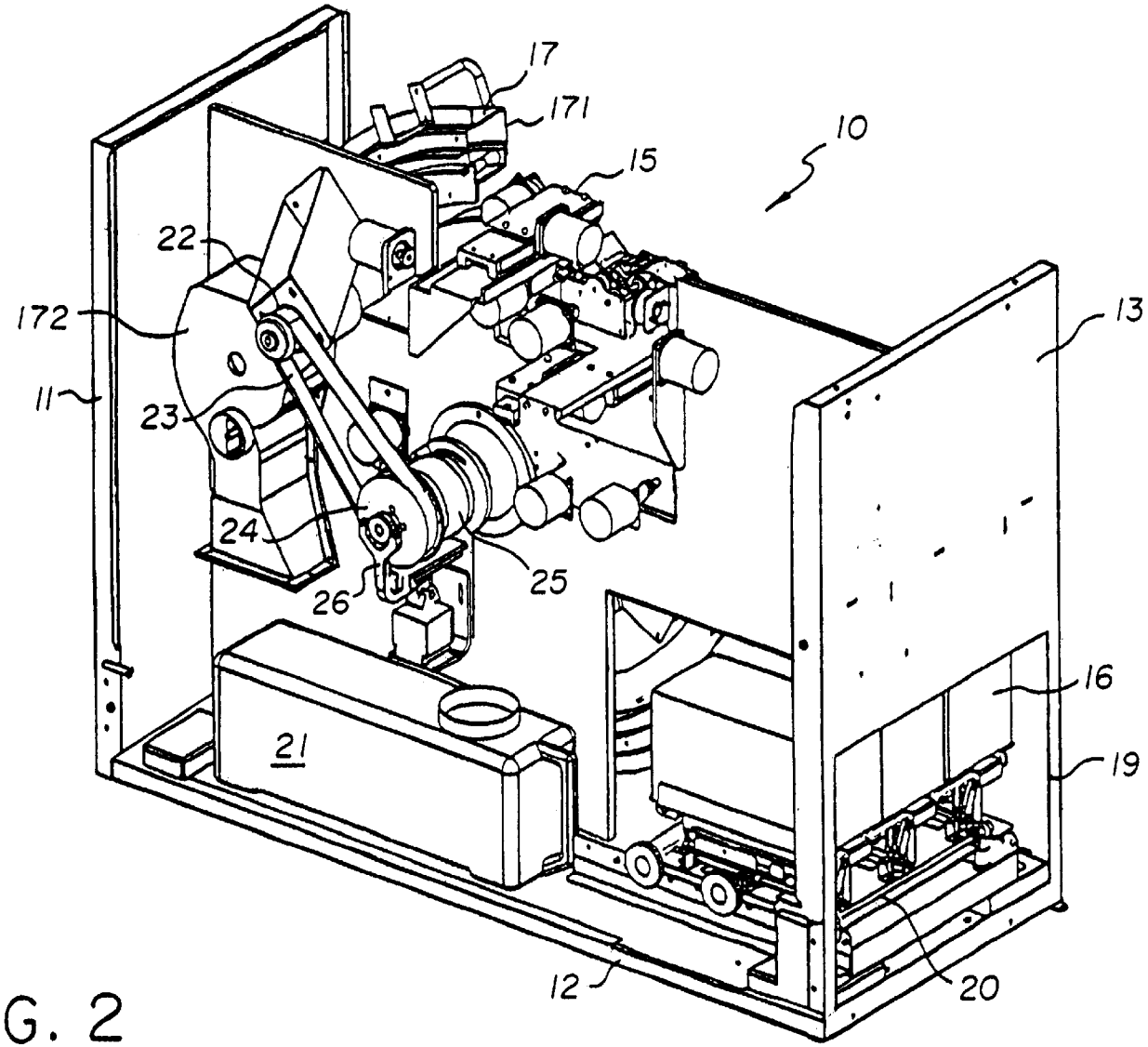
FIG. 2 is a rear view of the photographic processor.

FIG. 2 depicts a rear view of photographic processor 10. As shown in FIG. 2, photographic processor 10 includes opening 19 in side wall 13 for accessing chemical delivery system 16. Sliding track mechanism 20 allows an operator to pull at least a portion of chemical delivery system 16 through opening 19 to an exterior location outside of photographic processor 10. Such an assembly allows for quick and easy maintenance and replacement of chemical delivery system 16. Photographic processor 10 can include a waste collection reservoir 21, which collects and stores used processing chemicals removed from circular processing drum 14 following development of a given strip or roll of film. As shown in FIG. 2, dryer 17 includes dryer entrance 171 and dryer blower 172. The various components of photographic processor 10 will be described in more detail below with reference to FIGS. 3–21.

Figure 3:
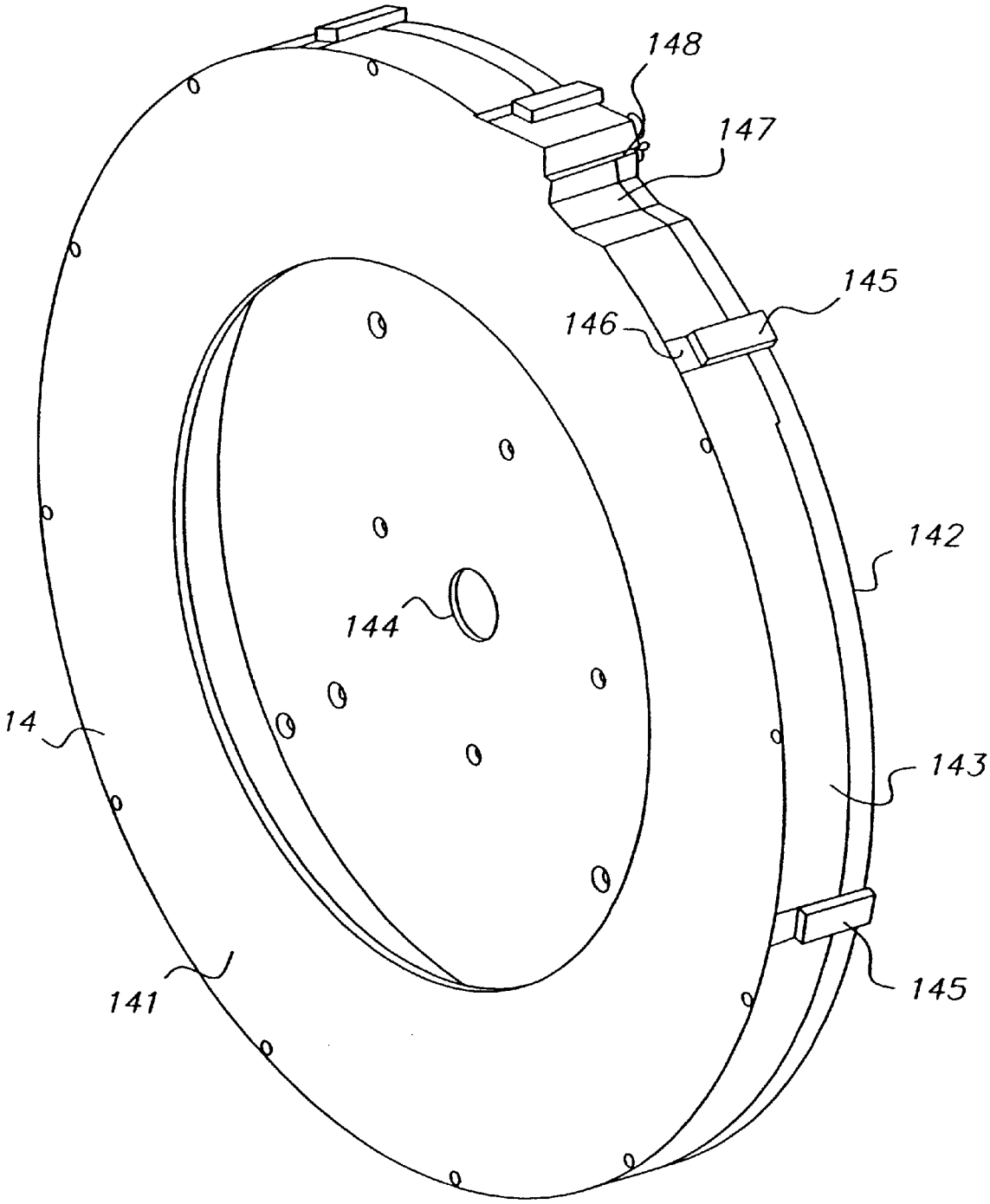
FIG. 3 depicts an exemplary circular processing drum used in the photographic processor.

Circular processing drum 14 is further described in FIG. 3. As shown in FIG. 3, circular processing drum 14 includes a first or front wall 141, a second or back wall 142, a side wall 143, and a central axis opening 144. A portion of a drum and disk drive mechanism 25 (shown in FIGS. 2, 8 and 9) passes through central access opening 144. Circular processing drum 14 comprises two circular sections joined together at multiple locations around the perimeter of circular processing drum 14 via male clasping members 145 and female clasping members 146. It should be noted that any means for attaching the two circular components of circular processing drum 14 may be used in place of male clasping members 145 and female clasping members 146. Further, it should be noted that circular processing drum 14 may also be in the form of a single component as oppose to two circular components as shown in FIG. 3, although such a design may add manufacturing cost to circular processing drum 14.

Circular processing drum 14 further comprises a film cartridge loading area 147 on an outer surface of side wall 143 for loading film directly from a film cartridge into circular processing drum 14, such as with APS film. Circular processing drum 14 also comprises a film input slot 148, which enables the entry and exit of film into circular processing drum 14.

Figure 4:
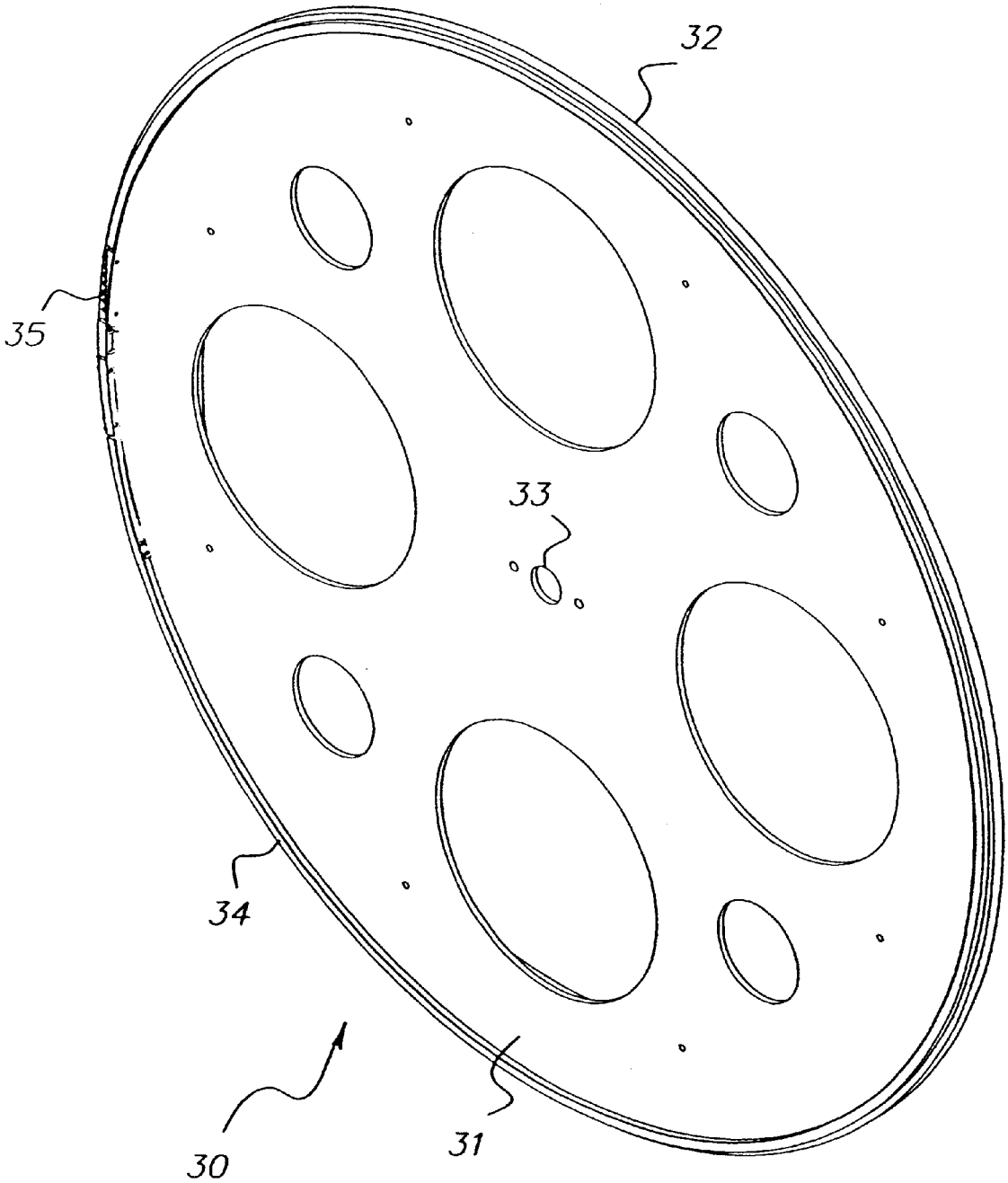
FIG. 4 depicts an exemplary disk located within the circular processing drum.
Figure 5:
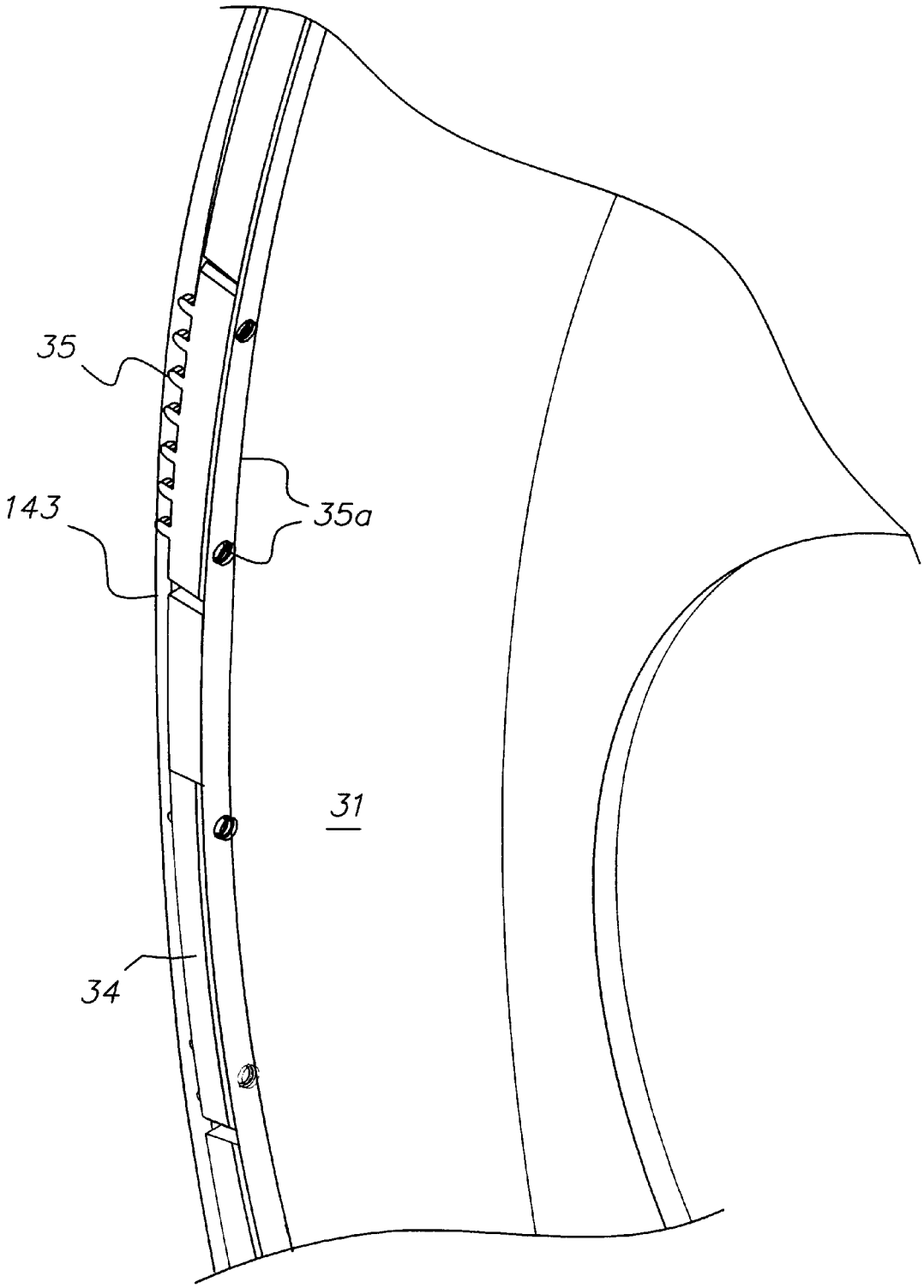
FIG. 5 displays a close-up view of the disk having an outer perimeter and one or more sets of disk teeth.
Figure 6:
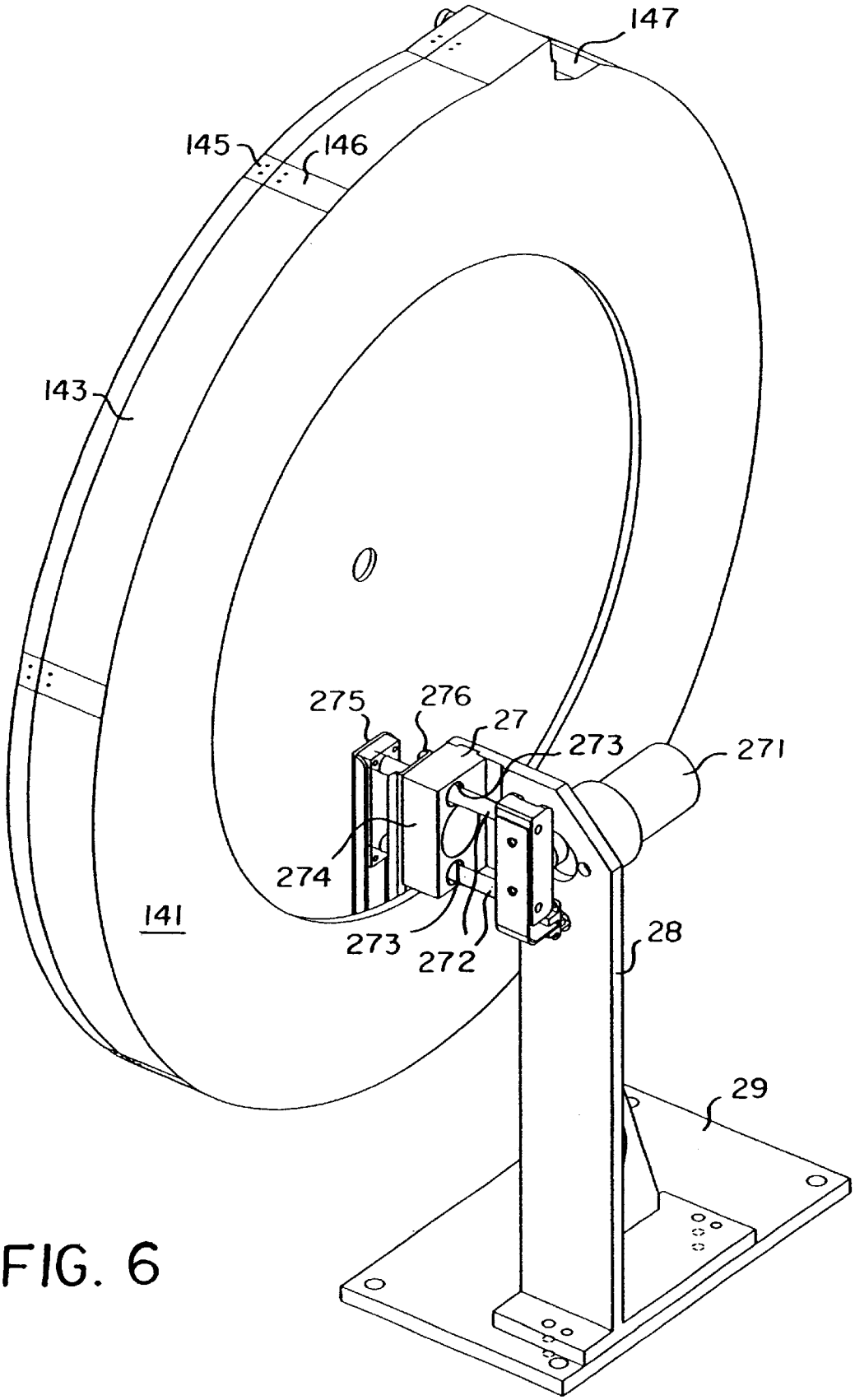
FIG. 6 depicts an exemplary roller mechanism positioned within the circular processing drum.

FIG. 4 depicts an exemplary disk 30, which is positioned within circular processing drum 14, and functions to convey film within circular processing drum 14 once the film enters through film input slot 148. Disk 30 includes a first face 31, a second face 32, a central access opening 33, an outer perimeter 34, and one or more sets of disk teeth 35 located along outer perimeter 34 of disk 30. As with circular processing drum 14, a portion of drum and disk drive mechanism 25 may extend into central access opening 33 to engage with and cause rotation of disk 30. FIG. 5 provides a close-up view of a portion of disk 30, and in particular, outer perimeter 34 and a set of disk teeth 35 on the outer perimeter 34 of disk 30. The outermost points of disk teeth 35 are in close proximity to an inner surface of side wall 143 of circular processing drum 14. In a feature of the invention, disk teeth 35 could be spring loaded through the use of spring arrangement 35*a*.

Figure 7:
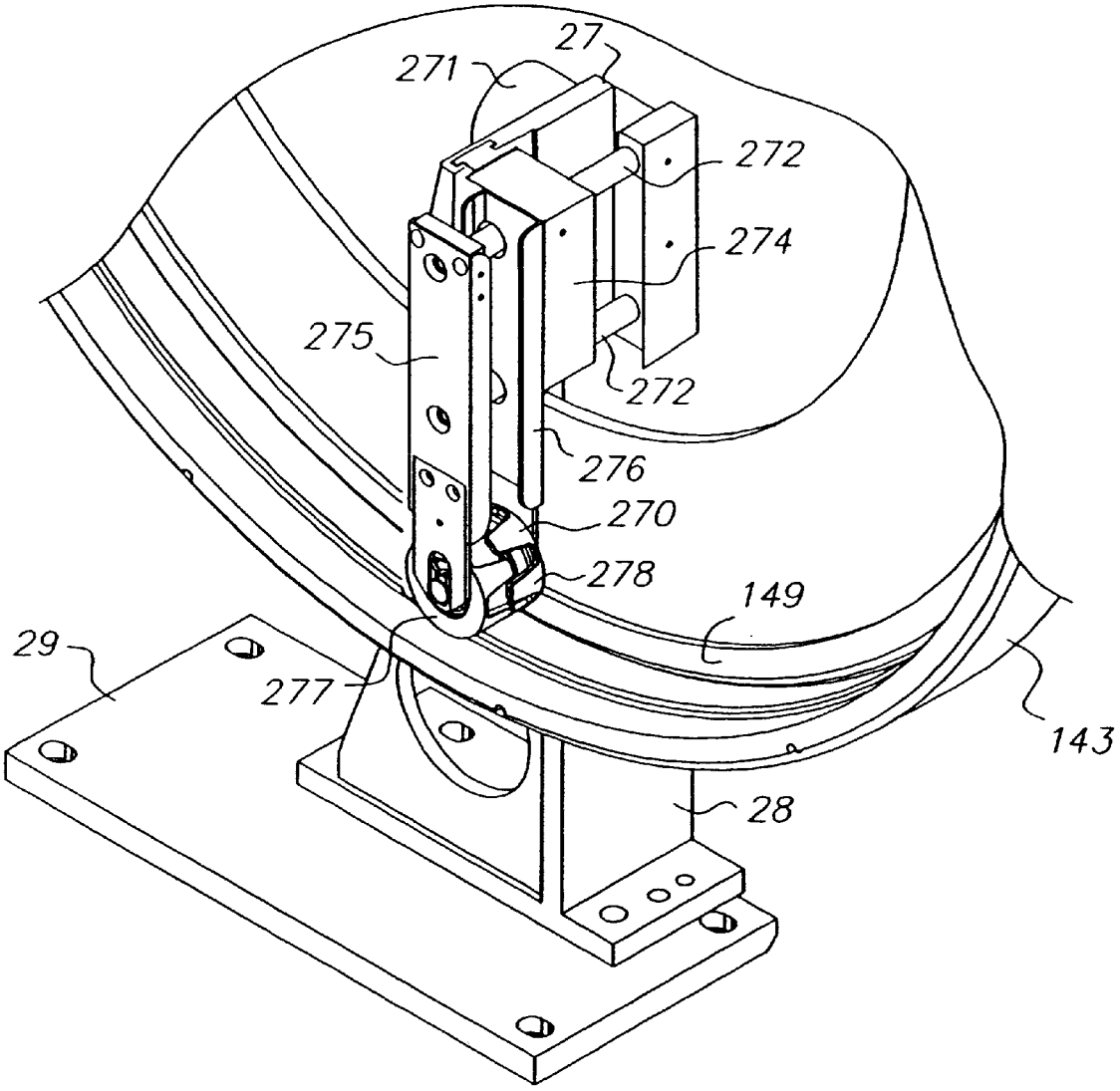
FIG. 7 depicts a rear view of the roller mechanism of FIG. 6.

A roller arrangement 27 (FIGS. 6 and 7) is positioned within circular processing drum 14. Roller arrangement 27 includes a roller 270 having interengaging members 277 and 278 (FIG. 7). Roller arrangement 27 may be supported by a support member 28, which is attached to a support member base 29. Support member base 29 may be permanently or temporarily attached to base housing member 12 (shown in FIGS. 1 and 2). Roller arrangement 27 includes a motor 271, which provides motion to pistons 272 through openings 273 in a fixed positioning member 274. Pistons 272 proceed through stationary positioning support member 276 and are attached to movable positioning support member 275. As pistons 272 move, movable positioning support member 275 which is coupled to member 277 separates from stationary positioning support member 276 which is coupled to member 278. This permits roller 270 to be expandable between a first width when the members 277 and 278 overlap each other and a second width larger than the first width (FIG. 7) when the members 277 and 278 move away from each other.

FIG. 7 provides a detailed view of roller arrangement 27 and its various components. As shown in FIG. 7, movable positioning support member 275 and stationary positioning support member 276 connect to interengaging members 277 and 278 respectively as described above. During use, the film passes between roller 270 and an interior surface of drum 14. Roller 270 is freely rotatable and maintains the film flat along the lower portion of drum 14. As will be described later, roller 270 further provides an agitating feature within processing drum 14 during processing. Additionally, the width of roller 270 is adjustable as described above to accommodate a shorter width film (i.e. APS film) and a larger width film (i.e. 35 mm film). Further, roller arrangement 27 including roller 270 can be vertically adjustable to accommodate for film curl as the film passes between roller 270 and the interior surface of drum 14. As a still further option, roller 270 can be spring loaded so as to accommodate any variation in the interior surface of drum 14.

Figure 8:
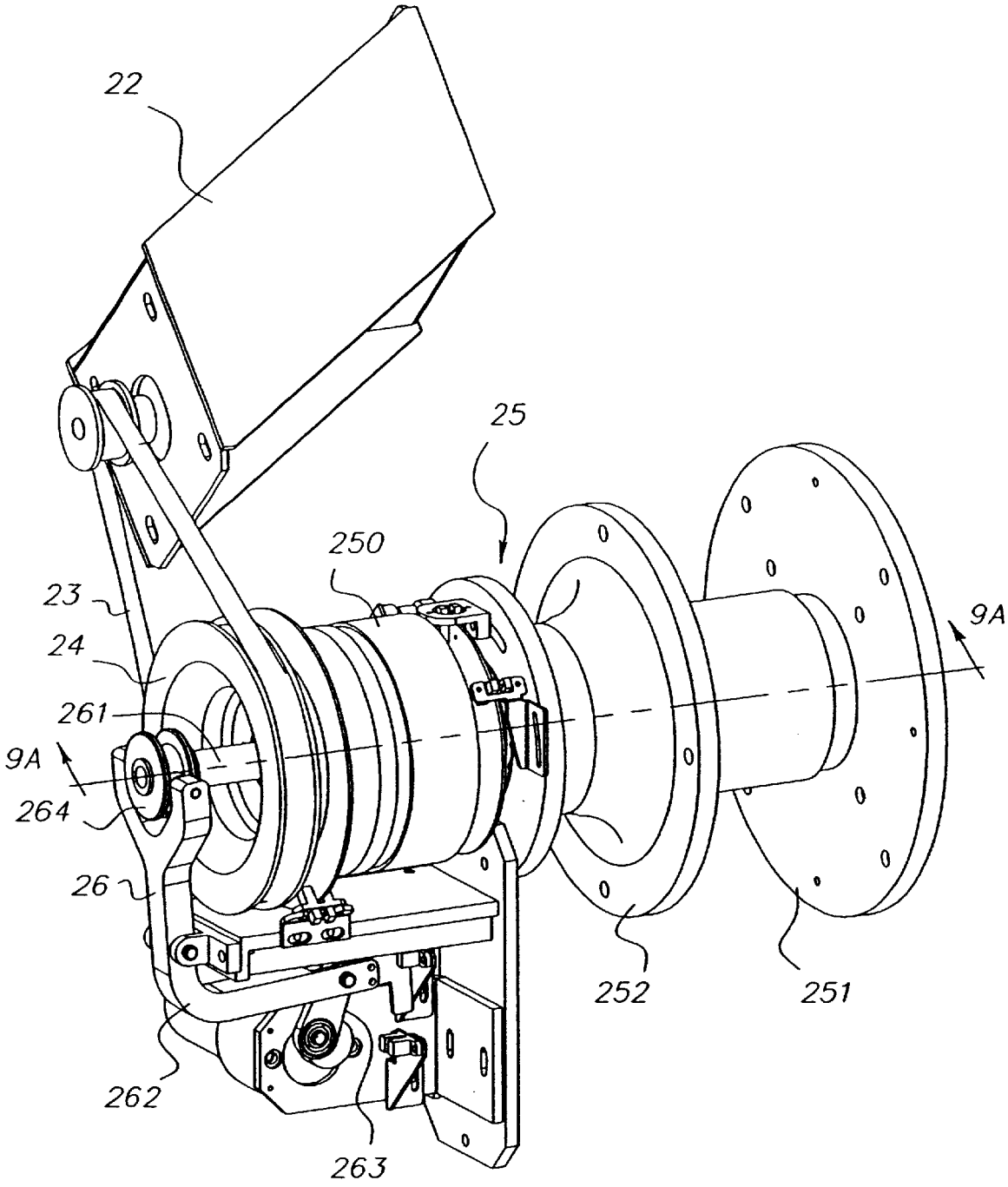
FIG. 8 depicts an exemplary drum and disk drive mechanism for rotating the circular processing drum, and a clutch mechanism for selectively engaging the drum and disk.
Figure 9A:
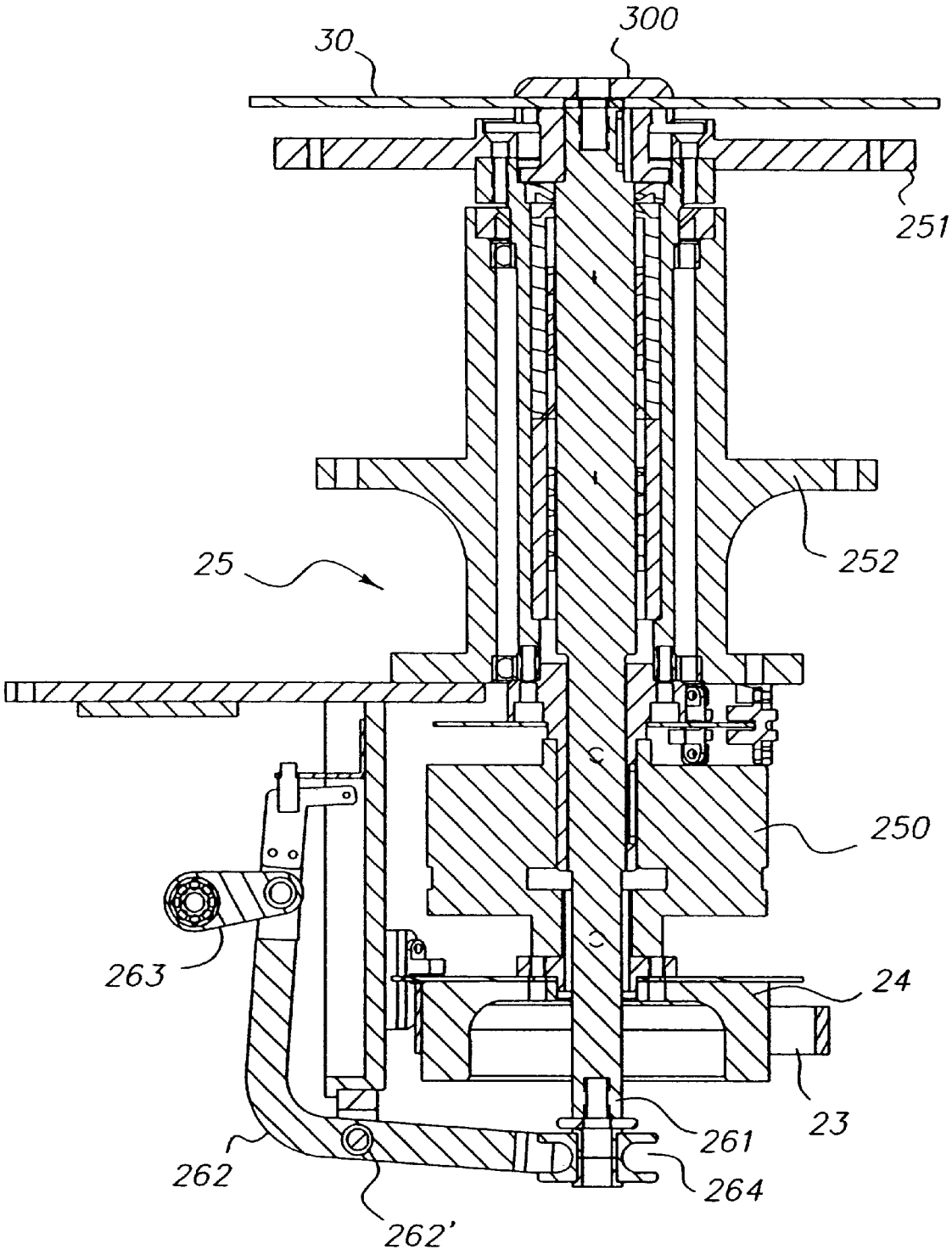
FIG. 9A displays a cross-sectional view of the drum and disk drive mechanism along line 9A—9A in FIG. 8.

Circular processing drum 14 is connected to a drum and disk drive mechanism 25, which selectively rotates disk 30 relative to drum 14 to position and convey the film along and within processing drum 14, and rotates both disk 30 and drum 14 together during a processing and/or cleaning cycle. Circular processing drum 14 rotates about an axis of symmetry. An exemplary drum and disk drive mechanism 25 is shown in FIG. 8. Drum and disk drive mechanism 25 cooperates with a motor 22, a belt 23, and a pulley 24 as shown in FIGS. 8 and 9A. Drum and disk drive mechanism 25 includes a drive shaft 261 which is operationally connected to pulley 24. Also shown in FIGS. 8 and 9A are flanges 251 and 252. Flange 251 is connected to drum 14 while an end cap 300 holds disk 30 for rotation about drive shaft 261 (FIG. 9A). Actuation of motor 22 drives belt 23 which in turn drives pulley 24. This in turn causes a rotation of drive shaft 261 which rotates disk 30. Clutch mechanism 250 enables the engagement and disengagement of flange 251 to provide selective rotation to circular processing drum 14.

Figure 9B:
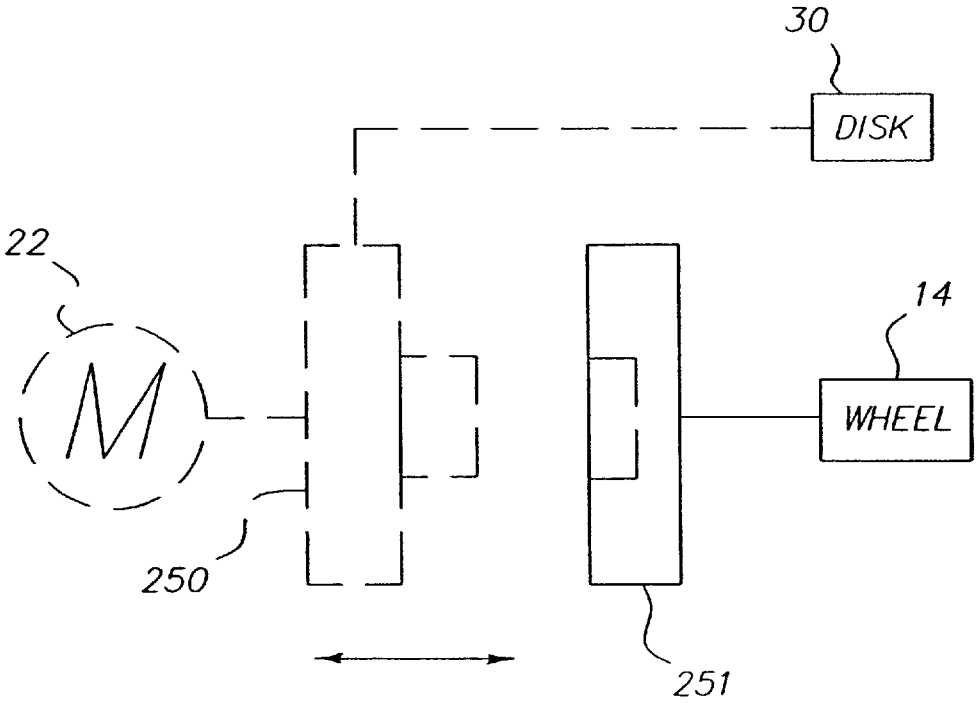
FIG. 9B schematically illustrates a driving and clutching arrangement.

FIG. 9A displays a cross-sectional view of drum and disk drive mechanism 25 and clutch mechanism 250 along line 9A—9A in FIG. 8. With reference to FIG. 9A and FIG. 9B which is a schematic representation of the driving and clutching feature of the present invention, an operation will now be described. When loading film which will be described with reference to FIGS. 10 and 11, clutch 250 is deactivated as shown in FIG. 9B. In this state, rotation of motor 22 will cause a rotation of drive shaft 261 and accordingly, a rotation of disk 30 relative to drum 14. This is due to the fact that clutch 250 is deactivated and therefore, drum 14 is not rotated. This permits the conveyance of the film by rotation of disk 30 to a desired location within drum 14. After the film reaches the desired location within drum 14, clutch 250 is activated, (for example, clutch 250 is moved to the right in FIG. 9B) by actuating clutch 250 with flange 251 which is attached to drum 14. Therefore, a rotation of motor 22 will cause a rotation of both disk 30 and drum 14. This occurs during the processing stages to process the film in a manner which will be described later, and also during a cleaning stage.

Drive shaft 261 can be moved perpendicularly and through flange 251 and flange 252 to move disk 30 attached thereto. As shown in FIG. 9A, drive shaft 261 is attached to a fitting 264 in a manner which permits drive shaft 261 to rotate relative to fitting 264. Fitting 264 is in turn rotatably attached to a pivotable arm 262 and a movable member 263. Movable member 263 can be operationally connected to a motor for rotation of member 263. This causes arm 262 to pivot about point 262' to move drive shaft 261 to the left or right when viewing FIG. 9A from above the page. Movement of drive shaft 261 as noted above, moves disk 30 in a direction parallel to an axis of disk 30. This facilitates the accommodation of, for example, 35 mm and APS film on disk 30, since the disk 30 can be moved based on the type of film being processed.

Figure 10:
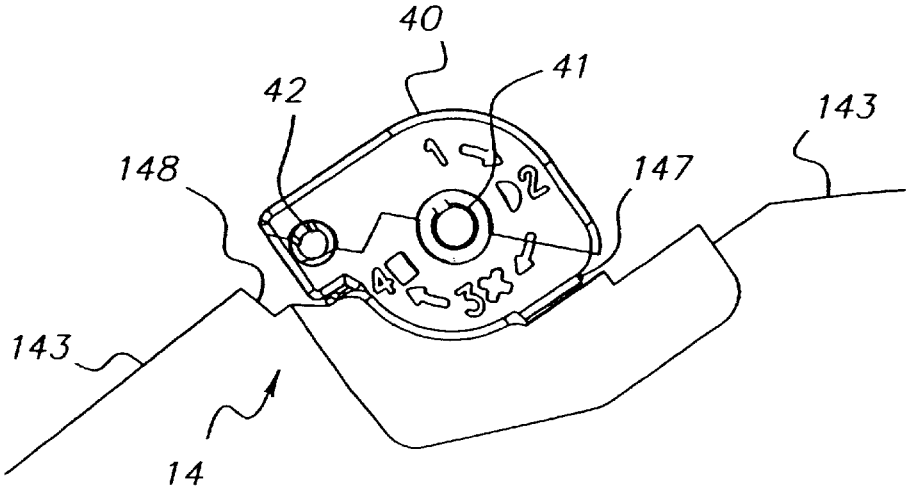
FIG. 10 depicts a film cartridge in a film-loading position using one film-loading method.

Within the context of the present invention, a film may be loaded into circular processing drum 14 by a number of methods. One method of loading film, such as APS film, into circular processing drum 14 is shown in FIGS. 10–13. As shown in FIG. 10, film cartridge 40 comprising a film cartridge spool 41 and film cartridge door opening mechanism 52 is positioned in a film cartridge loading area 147 located on side wall 143 of circular processing drum 14. Film (not shown) exiting film cartridge 40 enters circular processing drum 14 at light tight film input slot 148 (FIG. 3) in side wall 143 of circular processing drum 14.

Figure 11:
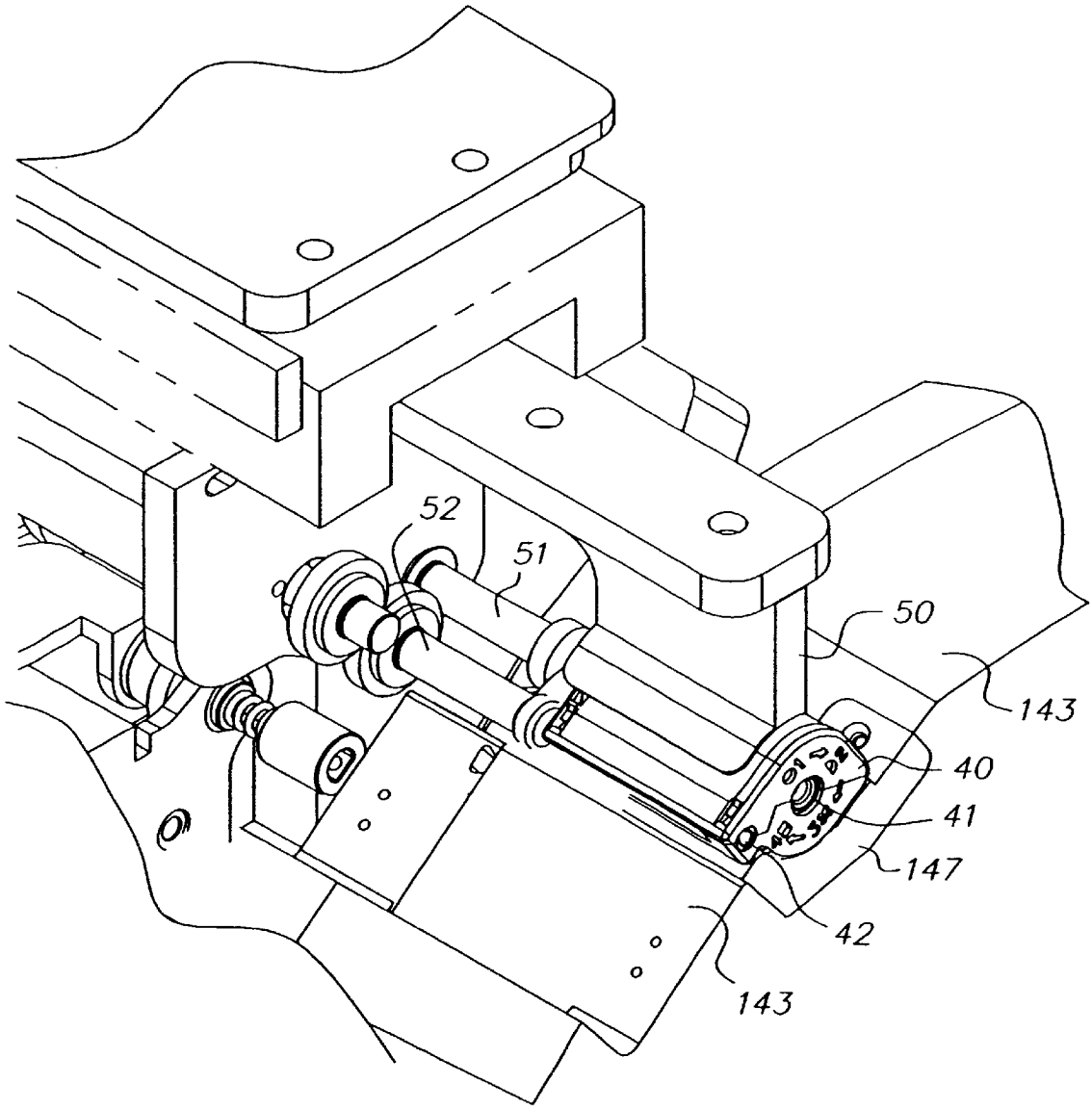
FIG. 11 depicts a film cartridge stabilizing step in one film-loading method.

Once film cartridge 40 is positioned in film cartridge loading area 147, photographic processor 10 can initiate a number of film-loading and conveying steps, the results of which are shown in FIG. 11. It is noted that the film loading and conveying steps as well as other processing steps can be controlled by a computer or central processing unit (CPU) 2000 (FIG. 1) operationally associated with processor 10. In a first step, a film cartridge stabilizing member 50 applies an amount of pressure onto an upper surface of film cartridge 40 to prevent film cartridge 40 from moving while positioned in film cartridge loading area 147. Spool engaging member 51 and cartridge door opening mechanism engaging member 52 move toward film cartridge 40 and engage with film cartridge spool 41 and film cartridge door 42, respectively. Door opening mechanism engaging member 52 opens film cartridge mechanism 42 and spool engaging member 51 begins to rotate film cartridge spool 41, forcing film (not shown) out of film cartridge 40.

Figure 12:
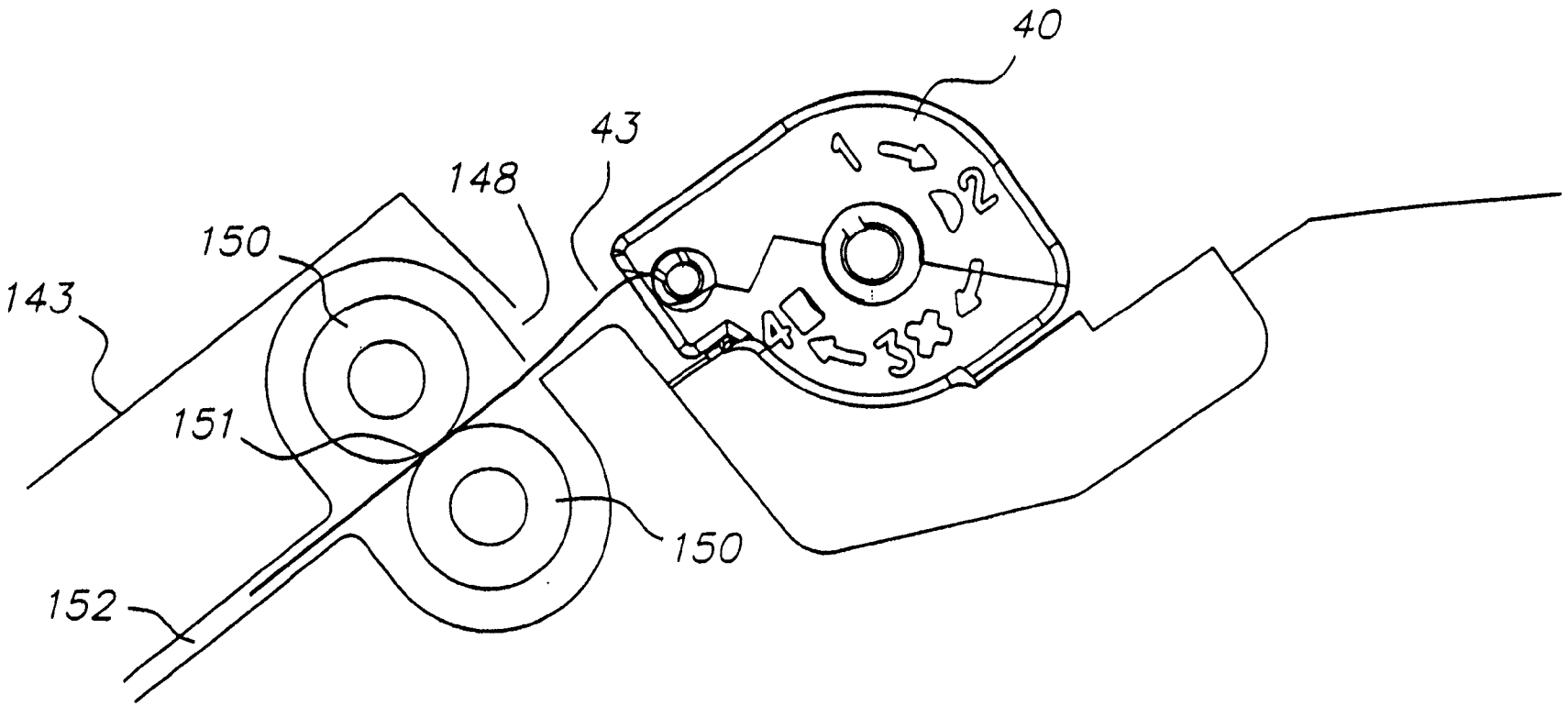
FIG. 12 depicts a film nipping step during a film-loading method.
Figure 13:
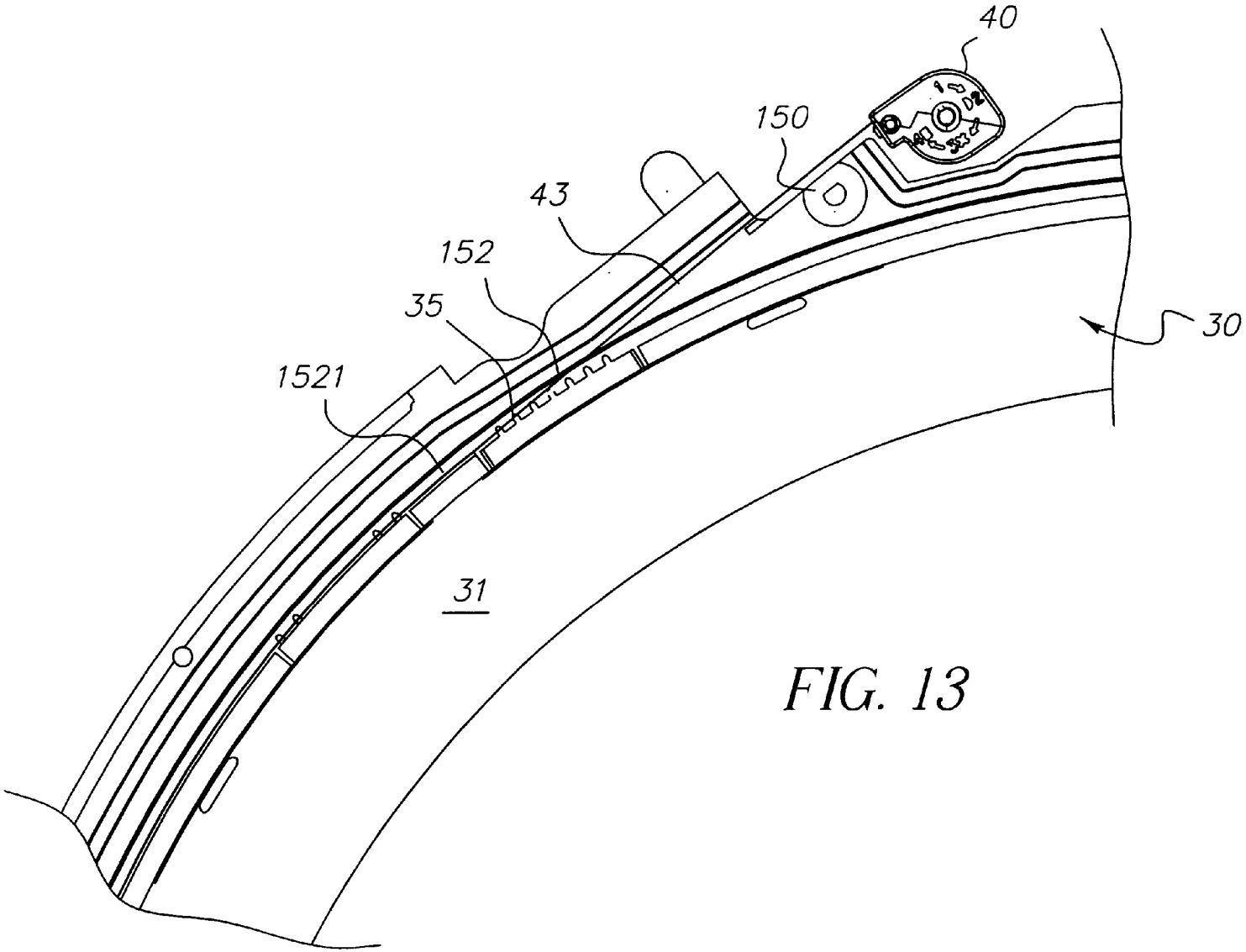
FIG. 13 depicts a cross-sectional view of film entering into the circular processing drum in one film-loading method.

FIG. 12 shows a strip of film 43 exiting film cartridge 40 and entering film input slot 148 of circular processing drum 14. Driven nip rollers 150 grasp a leading edge of the strip of film 43 at drum roller nip point 151 and advance film 43 further into circular processing drum 14. As shown in FIG. 13, the strip of film 43 exits drum cavity slot 152 and enters into the drum processing cavity 1521 of circular processing drum 14, wherein one or more sets of disk teeth 35 on disk 30 interengage with holes or perforations along an edge of the strip of film 43. As previously described, disk teeth 35 could be spring loaded so as to spring up at the appropriate time and interengage with the holes or perforations along film 43. With clutch 250 disengaged, disk 30 and rollers 150 are rotated while circular processing drum 14 remains stationary. This causes film 43 to advance into the processing cavity 1521 of circular processing drum 14 a desired distance equal to the length of the strip or roll of film 43. As shown in FIGS. 10–13, in this film-loading method the film 43 remains intact with film cartridge 40.

A number of commercially available films may be loaded according to the film-loading method described above, namely, wherein the film remains intact with its corresponding film cartridge during processing. A suitable film, which may be used in this particular film-loading method, includes, but is not limited to, APS film. Desirably, APS film is loaded into the photographic processor of the present invention according to this method.

Figure 14:
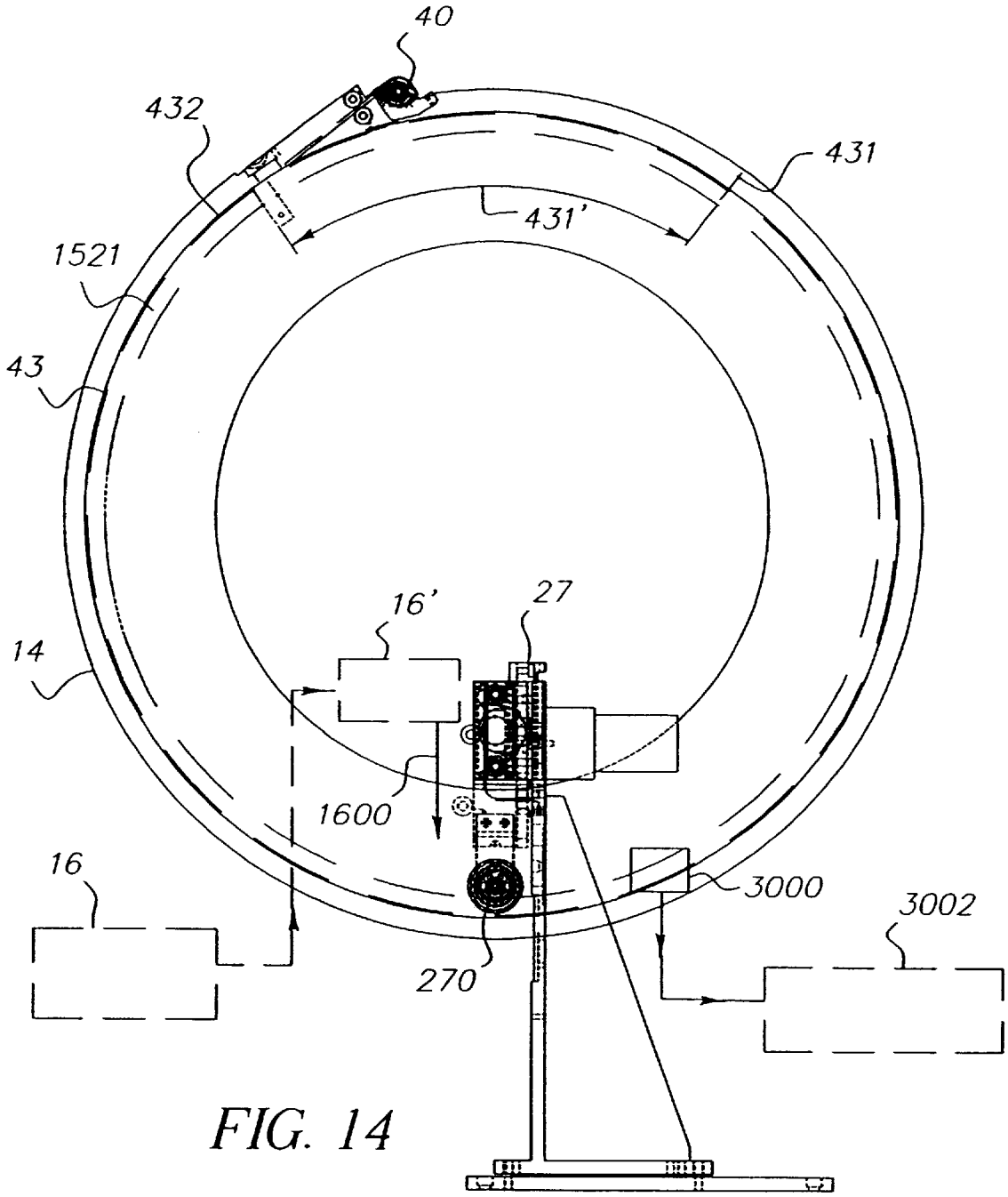
FIG. 14 depicts a sheet of film having a lead end and a tail end within the drum processing cavity of a circular processing drum.

FIG. 14 depicts circular processing drum 14 fully loaded with film 43 having a forward end 431 and a rearward end 432 within the drum processing cavity 1521 of circular processing drum 14. The back end of film 43 is maintained in cartridge 40. Film 43 is now positioned within circular processing drum 14 for chemical processing, wherein one or more processing fluids are deposited into circular processing drum 14 and placed in contact with film 43 for a desired period of time.

It is noted that the circumference of the drum will be longer than the length of the film to be processed. Therefore, when the film is loaded in drum 14, a section of drum 14 will not have film therein. This is referred to as a film-free zone 431 ' (FIG. 14). Prior to delivering chemistry by way of chemical supply 16 and a chemical delivery mechanism 16' (FIG. 14), clutch 250 is activated or engaged and drum 14 is controllably rotated with disk 30 so that film-free zone 431 ' is at a lower end or below chemical delivery mechanism 16'. Chemical delivery mechanism 16' is preferably of the type which drops or delivers chemistry into drum 14 in the direction of arrow 1600 (FIG. 14). The movement of film-free zone to an area below chemical delivery mechanism 16' prior to the delivery of chemicals prevents the chemicals from being dropped directly on the film which could cause uneven processing. Thereafter, processing occurs by continuously rotating the drum 14 and disk 30. Further, as shown in FIG. 14, in the lower portion of drum 14, film 43 passes between wheel 270 and an inner surface of drum 14. Rotation of drum 14 and disk 30 relative to wheel 270 helps to agitate the processing fluid in the vicinity of wheel 270 to promote processing. Drum 14 can be selectively rotated in a continuous or intermittent manner. Following the chemical processing steps, the film 43 is removed from circular processing drum 14 and exposed to a drying operation. One method of removing film 43 from circular processing drum 14 is shown in FIGS. 15A and 15B.

Figure 15A:
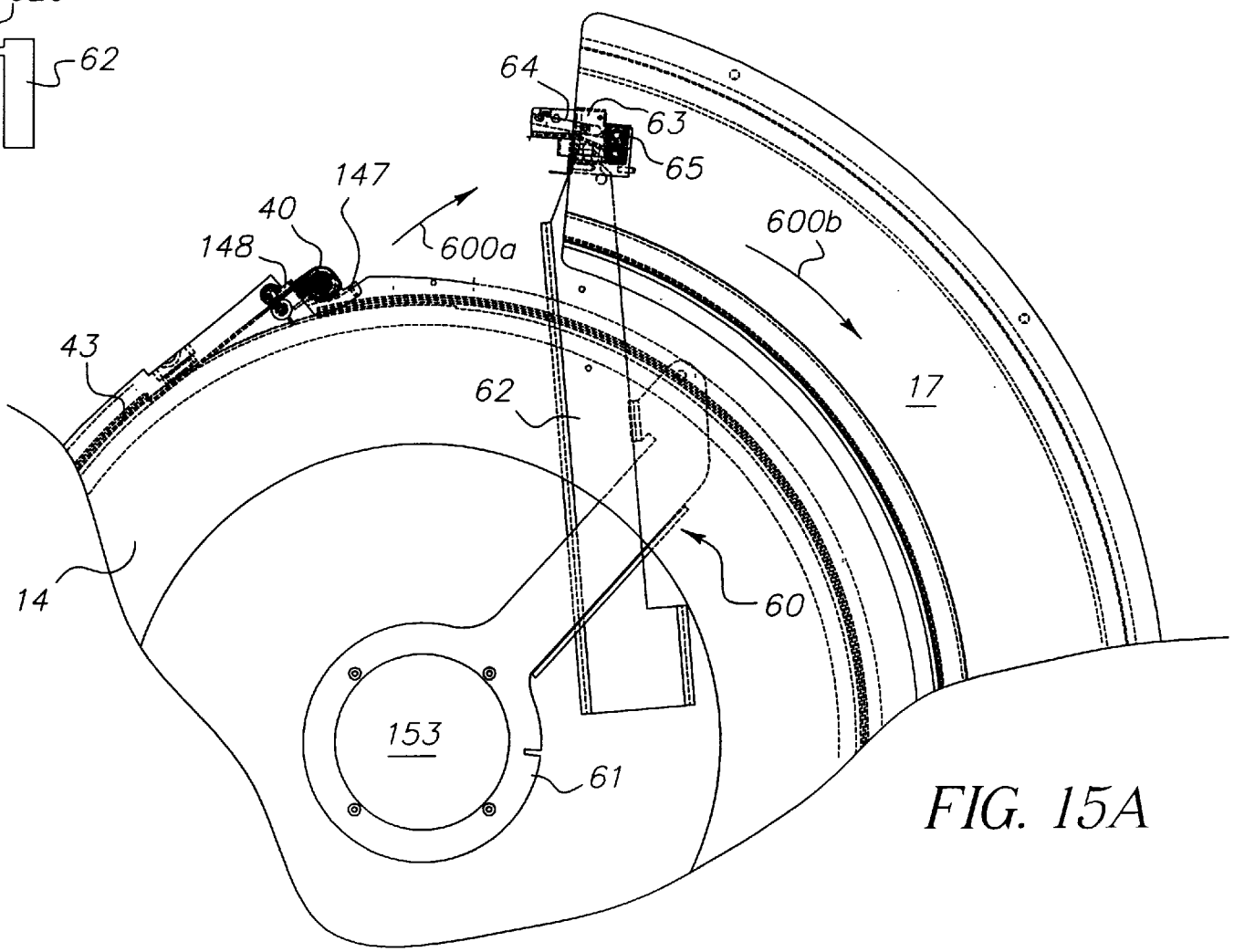
FIGS. 15A and 15B depicts an exemplary film transfer arm, which transfers film from a circular processing drum to a dryer.
Figure 15B:
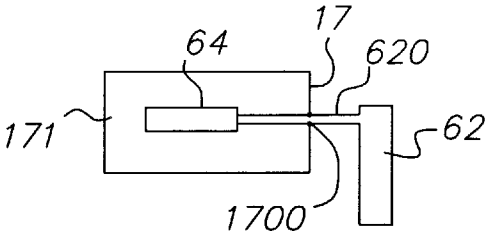

As shown in FIG. 15A, film transfer arm assembly 60 is positioned to move or pivot between circular processing drum 14 and dryer 17. Film transfer arm assembly 60 includes a lower arm member 61, which is rotatable around an axis of symmetry 153 of circular processing drum 14. Film transfer arm assembly 60 also includes an upper arm member 62, which is pivotally attached to lower arm member 61. At upper arm member end 63, film transfer arm assembly 60 includes a film cartridge gripper 64 and film strip gripper rolls 65. As shown in FIG. 15B, which is a front view of the entrance of dryer 17, a side wall of dryer 17 includes a slot 1700 with a rubber seal that extends along the length of the dryer. Upper arm member 62 includes a shaft 620 which extends from upper arm member 62, through slot 1700 and is connected to gripper 64. This permits transfer arm assembly 60 to pull gripper 64 and thus the film to be dried though the dryer.

In embodiments wherein the film 43 remains intact with film cartridge 40 (as described above), film cartridge gripper 64 of film transfer arm assembly 60 engages with film cartridge 40, pulls film cartridge 40 from loading area 147 and the strip of film 43 from circular processing drum 14 in direction 600*a*, and proceeds through dryer 17 in direction 600*b*. Therefore, cartridge 40 with processed film 43 attached and trailing therefrom is conveyed through dryer 17 to dry film 43 by, for example, the blowing of air into dryer 17. In other embodiments where the film 43 is detached from film cartridge 40 (described below), film sheet gripper rolls 65 grip an edge of film 43 as film 43 exits film input slot 148 of circular processing drum 14. Film sheet gripper rolls 65 of film transfer arm assembly 60 pull film 43 from circular processing drum 14 and proceeds through dryer 17. Once dried, film 43 is re-wound back into its cartridge 40 prior to proceeding to scanner 18'.

Figure 16:
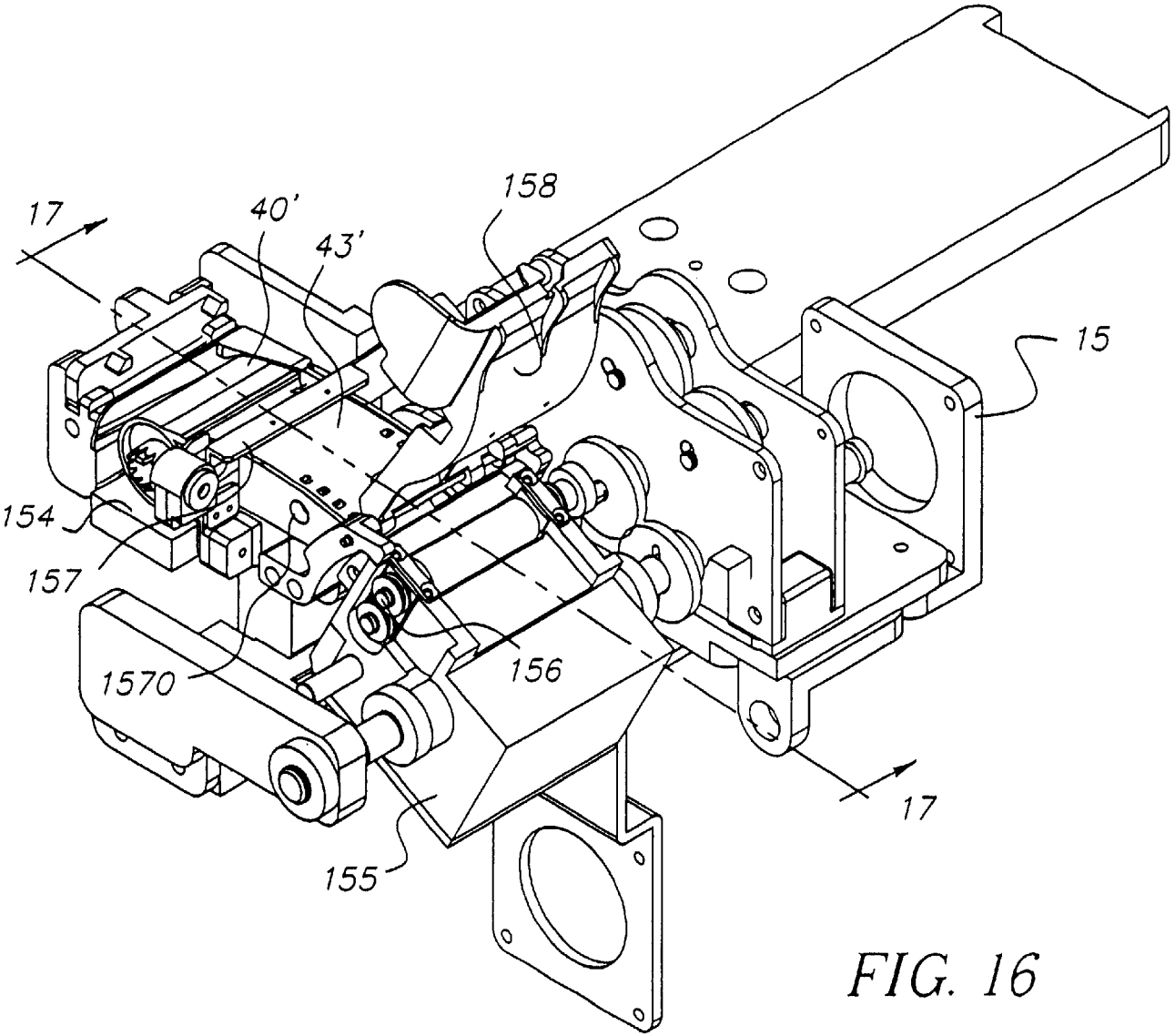
FIG. 16 depicts an exemplary film loading/unloading device used in a film-loading method wherein film is separated from its corresponding film cartridge.

In a further film-loading method, the film is separated from its film cartridge prior to processing within circular processing drum 14 (for example, 35 mm film). In this method, a film loading/unloading device, such as exemplary film loading/unloading device 15 as shown in FIG. 16, may be used. Film loading/unloading device 15 includes a film cartridge loading area 154, which can be enclosed by closing a door 158. In film loading area 154, an operator extracts the tongue of film 43' from cartridge 40' and engages the perforations on film 43' with sprockets on a driven roller 1570. Thereafter door 158 is closed and film 43' proceeds into festoon box 155 through festoon box nip rollers 156. Once a desired length of film is removed from film cartridge 40', a cutter 157 slices film 43' to separate film 43' from film cartridge 40'. Any counter device (not shown) may be used to measure the length of the strip of film 43' passing through festoon box nip rollers 156. The length measurement is used in further processing steps as described below.

Figure 17:
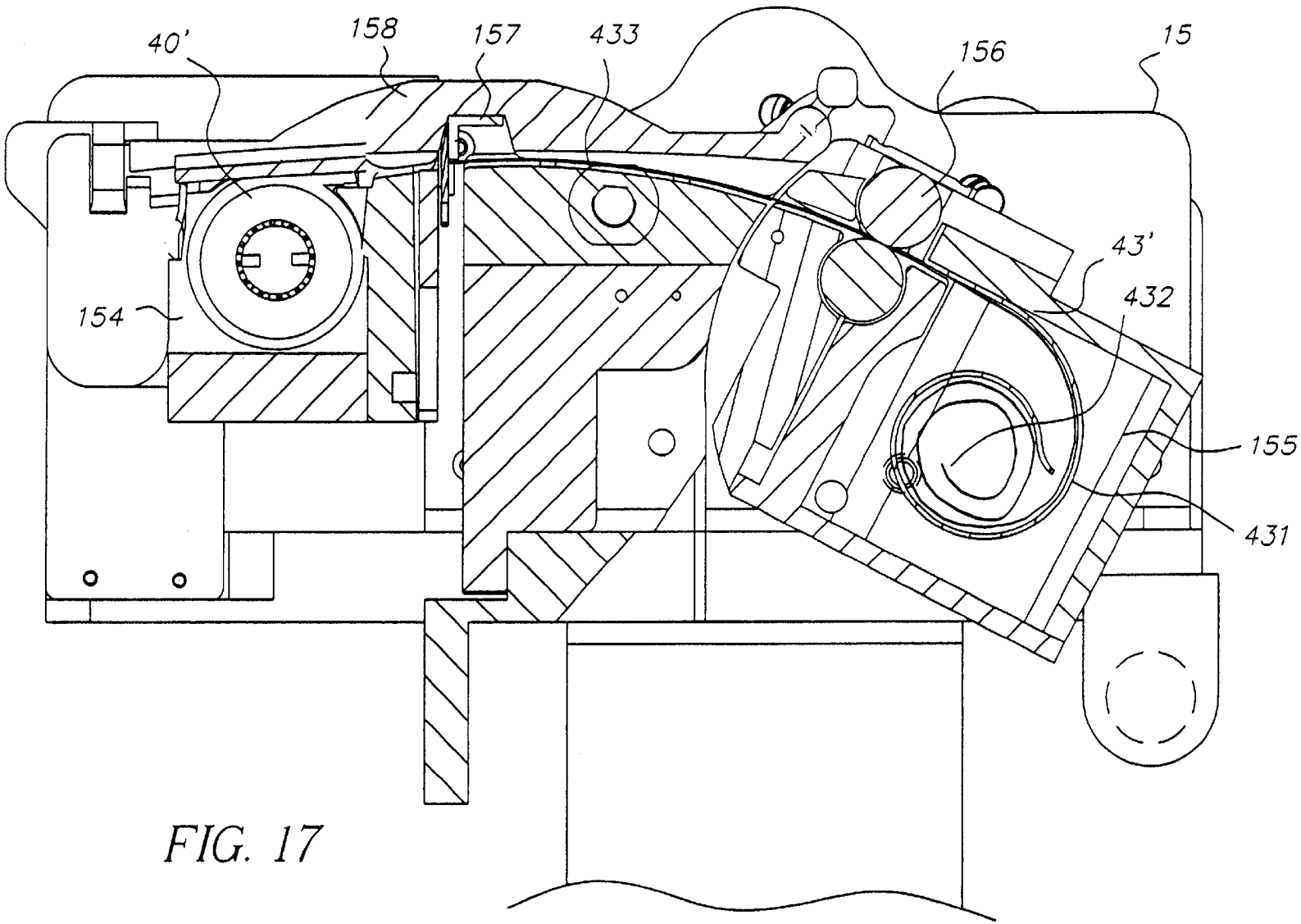
FIG. 17 depicts a cross-sectional view of the exemplary film loading/unloading device as seen along line 17—17 in FIG. 16.

FIG. 17 depicts a cross-sectional view of film loading/unloading device 15 as seen along line 17—17 in FIG. 16. As shown in FIG. 17, film cartridge 40' is positioned in film cartridge loading area 154 while a strip of film 43' is removed from film cartridge 40' and transported to festoon box 155 where it is turned. In this film-loading operation, a reverse roll of film 431 is formed from the film 43' in festoon box 155. A lead end of film 432 becomes the innermost portion of the reverse roll 431 while a tail end of film 433 becomes the outermost portion of reversed roll 431. When the film 43' is subsequently fed into circular processing drum 14 (as previously described), tail end 433, which contains the last exposures on the strip of film 43', is fed into circular processing drum 14 first.

Figure 18:
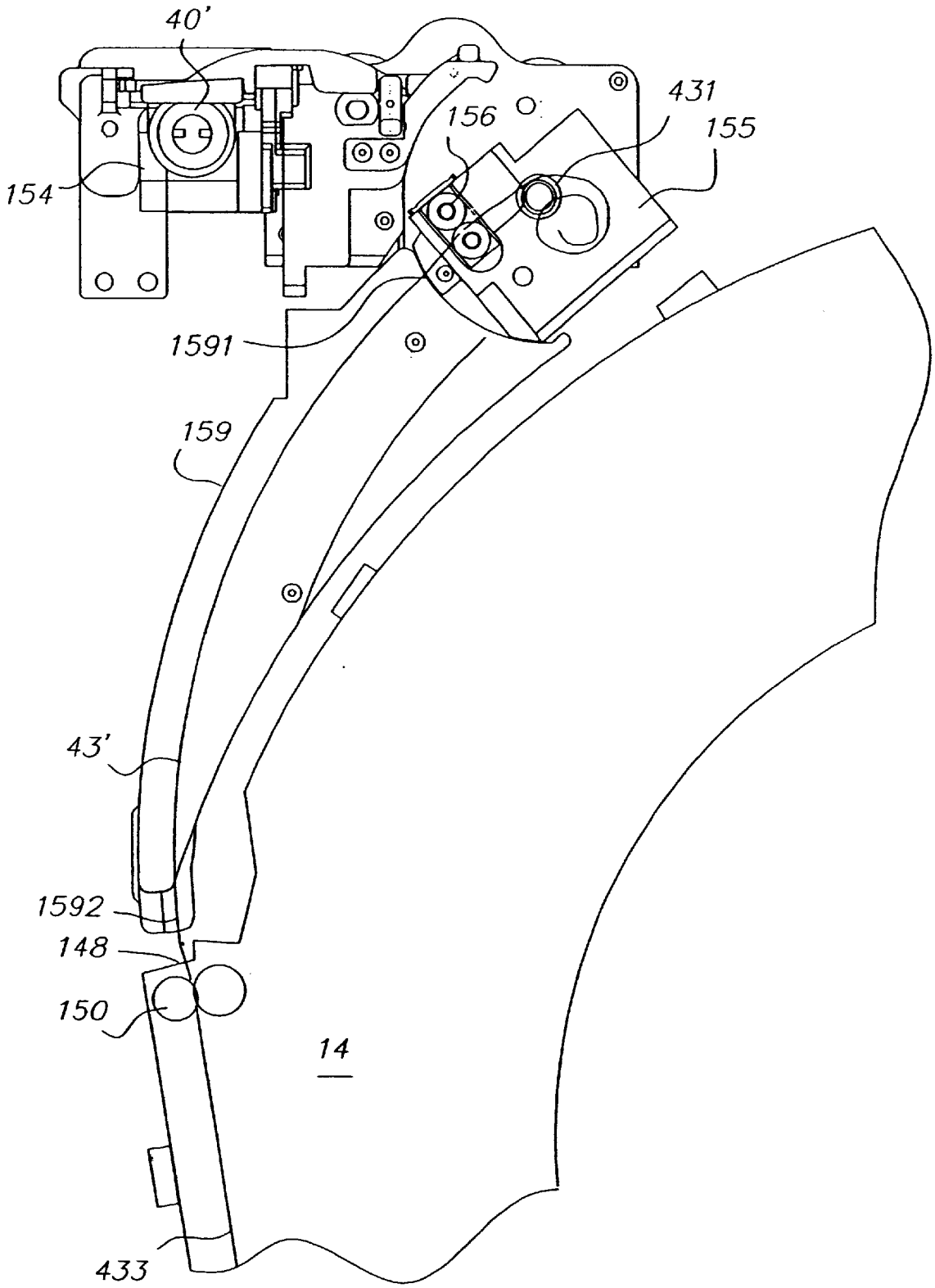
FIG. 18 depicts an exemplary film-loading guide used to load a film roll into a circular processing drum.

A film-loading guide 159 is used to load reverse roll 431 into circular processing drum 14 as shown in FIG. 18. Festoon box 155 rotates from an initial position (as shown in FIGS. 16 and 17) to a film-loading position as shown in FIG. 18. Festoon box nip rollers 156 turn to advance tail end 433 of reverse roll 431 into film-loading guide 159 at guide entrance slot 1591. The film 43' exits the film-loading guide 159 at guide exit slot 1592 positioned adjacent to film input slot 148 of circular processing drum 14. Once the tail end 433 of the strip of film 43' enters into circular processing drum 14, driven nip rollers 150 grab the film 43' and advance the film 43' into circular processing drum 14 as described above. It should be noted that in this film-loading method, nip rollers 150 are programmed to advance the film 43' into circular processing drum 14 a specific length, which corresponds to the length of film inputted into festoon box 155 and measured via festoon box nip rollers 156 as described above. In other words, nip rollers 150 advance the strip of film 43' into circular processing drum 14 so that lead end 432 of film 43' remains nipped between nip rollers 150 during chemical processing (i.e., lead end 432 of the strip of film 43' does not enter into drum processing cavity 1521). This permits all of the exposed areas of the film 43' to be in the processing area in the drum.

Figure 19:
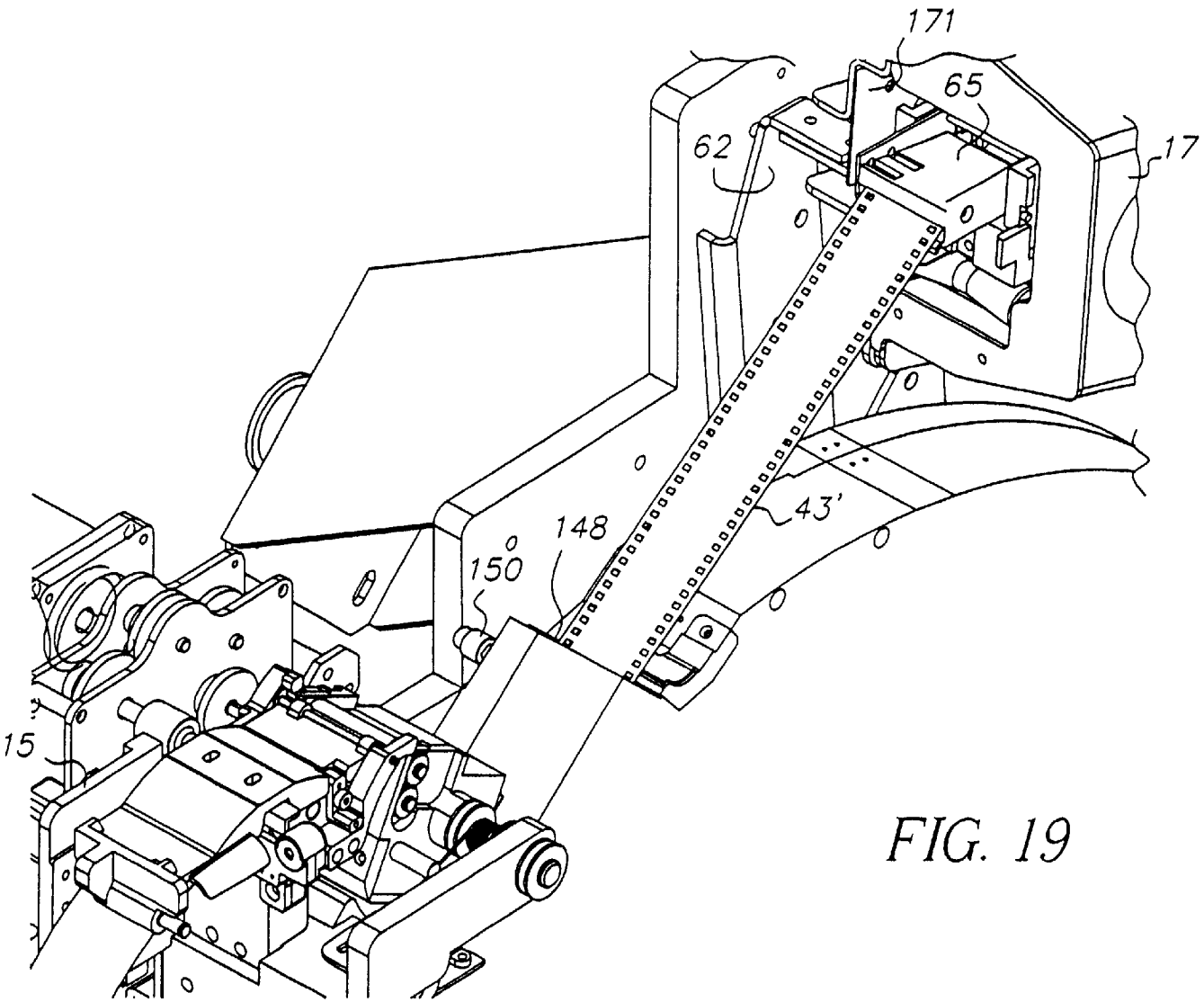
FIG. 19 depicts a film transfer step, wherein a strip of film is transferred from a circular processing drum to a dryer by film sheet gripper rolls attached to a film transfer arm.
Figure 20:
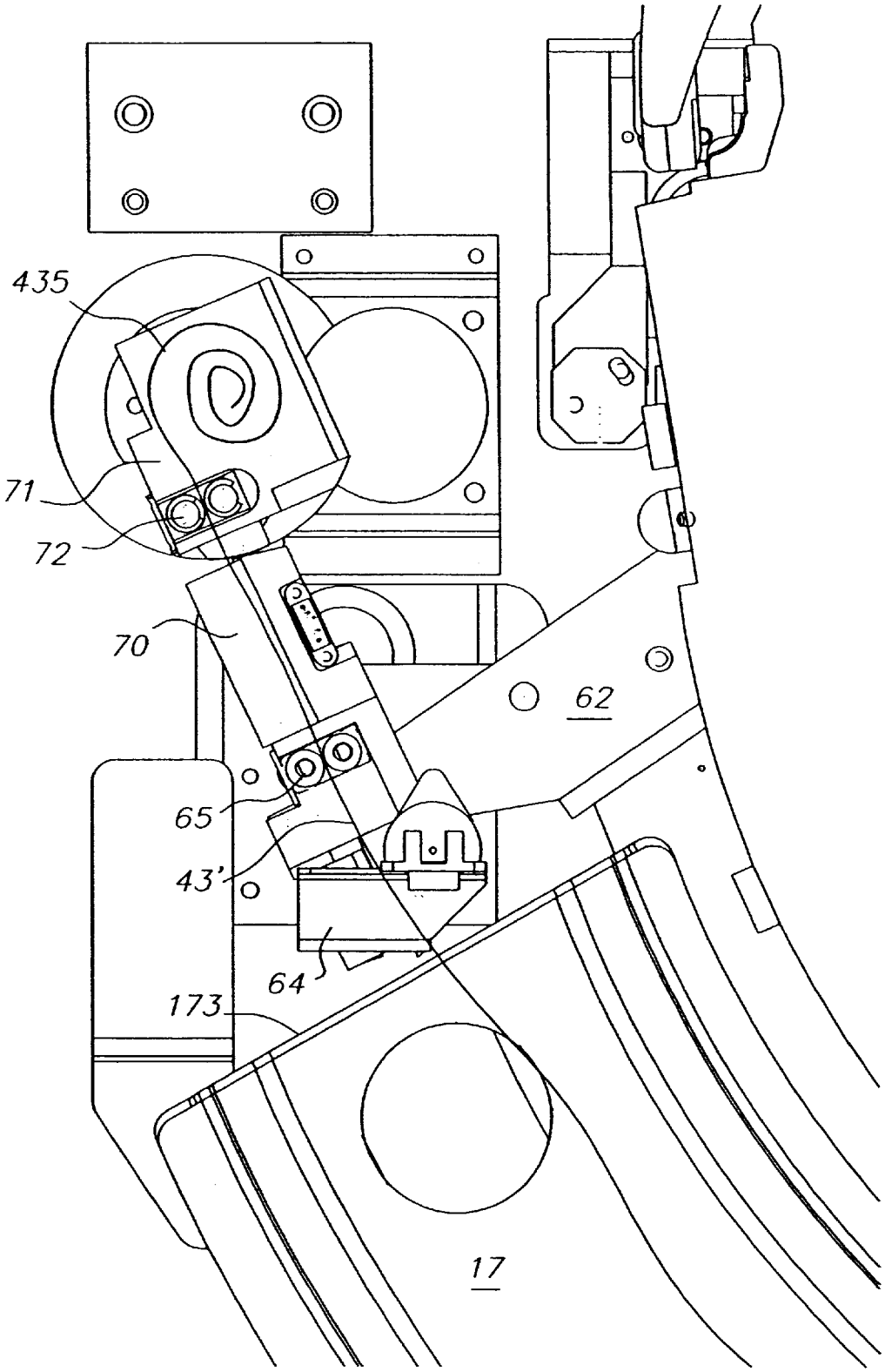
FIG. 20 depicts a film processing step, wherein a strip of film exits a dryer into a scanner festoon box.

Following the chemical processing steps, film 43' is transferred to dryer 17 by film transfer arm assembly 60 as described above. As shown in FIG. 19, the strip of film 43' is pulled from circular processing drum 14 through film input slot 148 by film sheet gripper rolls 65 attached to upper transfer arm member 62. Nip rollers 150 provide a first end (corresponding to lead end 432) to film sheet gripper rolls 65. In FIG. 19, film sheet gripper rolls 65 are shown positioned at dryer entrance 171. From this position, film sheet gripper rolls 65 proceed through dryer 17 pulling the film 43' through dryer 17. As shown in FIG. 20, upper film transfer arm member 62 exits dryer 17 at dryer exit 173 and comes into contact with a conduit 70. Film sheet gripper rolls 65 turn to advance the film 43' through conduit 70 and into scanner festoon box 71. Scanner festoon box nip rollers 72 grasp a leading edge of film 43' and force film 43' into scanner festoon box 71 forming scanner film roll 435. Scanner festoon box nip rollers 72 advance film 43' into scanner festoon box 71 a specific distance equal to the predetermined length of film 43' so that the tail end of film 43' remains nipped between scanner festoon box nip rollers 72 to go to the scanner.

Figure 21:
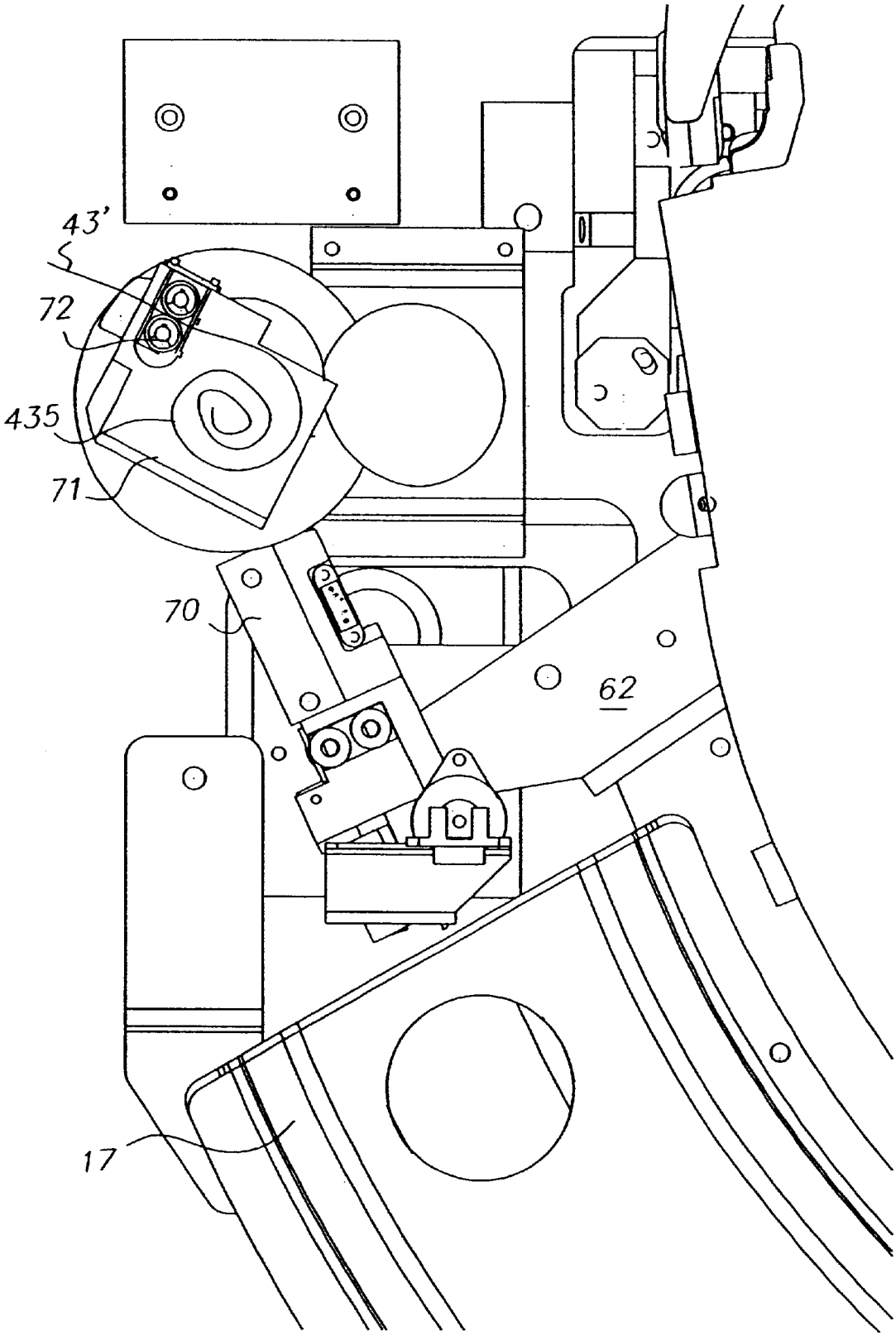
FIG. 21 depicts a film processing step, wherein a strip of film exits a festoon box and proceeds to a scanner.

In one embodiment, film 43' may be further processed by transporting the film 43' to scanner 18'. As shown in FIG. 21, scanner festoon box 71 rotates from an initial position (as shown in FIG. 20) to a secondary position so that the film 43' may be fed to scanner 18'. Scanner 18' may supply image data to computer 2000 or a remote computer (not shown) for further image processing. Following scanning, the film 43' may be packaged as a film roll or as strips of film and returned to the customer along with scanned photographs in electronic format on an electronic disc if desired.

A number of commercially available films may be loaded according to the film-loading method described above, namely, wherein the film is separated from its corresponding film cartridge during processing. Suitable films, which may be used in this particular film-loading method, include, but are not limited to, 135 mm film. Desirably, 135 mm film is loaded into the photographic processor of the present invention according to this method.

The photographic processor as described may be used to process one or more types of film. Suitable films include, but are not limited to, APS film, 135 mm film, etc. Desirably, the photographic processor is designed to process APS film, 135 mm film, or both APS and 135 mm film. The photographic processor may be categorized as a "single-roll", "single use" or "batch" processor given that the circular processing drum only chemically processes one roll of film at a time.

The photographic processor as described may include other components other than those described in FIGS. 1–21. For example, the photographic processor may include an operator interface control panel operationally associated with computer 2000 (FIG. 1); a display screen; a control unit, wherein the control unit accepts input from a processor user, provides machine settings to one or more components of the processor based on the input of the user, and controls and executes a processing operation of the processor; and multiple film loading doors on an outer surface of the photographic processor housing. In one desired embodiment, the photographic processor is used to process APS film and 135 mm film. In this embodiment, the photographic processor has two separate film loading doors on an outer surface of the photographic processor housing, one for an APS film cartridge and the other for a 135 mm film cartridge.

The photographic processor as described may use any conventional chemical delivery system known in the art as long as the chemical delivery system is capable of inputting one or more processing fluids into the circular processing drum. Suitable chemical delivery systems deliver one or more processing fluids including, but not limited to, a developing solution, a bleach solution, a fix solution, a wash solution, a combination or a concentrate thereof. Desirably, the chemical delivery system comprises one or more separate containers for each of the processing fluids. For example, the chemical delivery system may comprise one or more separate containers containing a developing solution, one or more separate containers containing a bleach solution, one or more separate containers containing a fix solution, and one or more separate containers containing a wash solution. In one embodiment of the present invention, the chemical delivery system used in the photographic processor comprises one container of developing solution, one container of bleach solution, one container of fix solution, and at least one container of wash solution.

Desirably, the photographic processor of the present invention utilizes a chemical delivery system comprising "working strength" chemical solutions. As used herein, the term "working strength" is used to describe chemical solutions, which are prepackaged in separate containers at concentrations that do not require dilution with other solutions (i.e., a source of water), and can be used as is. The system can very easily work with concentrates that are measured, diluted and heated on board. They can be diluted with water (if a supply is available) or with a simple rinsing solution that contains water and a surfactant.

Further, the photographic processor as described may use any conventional chemical removal system to remove or discard one or more processing fluids from the circular processing drum. Suitable chemical removal systems include, but are not limited to, a suction device or a drain 3000 (FIG. 14) in the side wall of the circular processing drum. Typically, the chemical removal system further comprises a chemical waste reservoir 3002 (FIG. 14) for storing one or more processing fluids removed from the drum. Desirably, the chemical waste reservoir is designed to contain all of the waste resulting from the use of all of the processing fluids contained in the chemical delivery system.

As discussed above, in batch processors the components of the processor are subject to soiling. Further, due to infrequent use, batch processors are also subject to deposits being formed on components of the processor such as the rollers. Therefore, cleaning of the processor is beneficial for maintaining image quality, and necessary for maintaining smooth operation of the sensitized media loading/unloading mechanisms.

Figure 22:
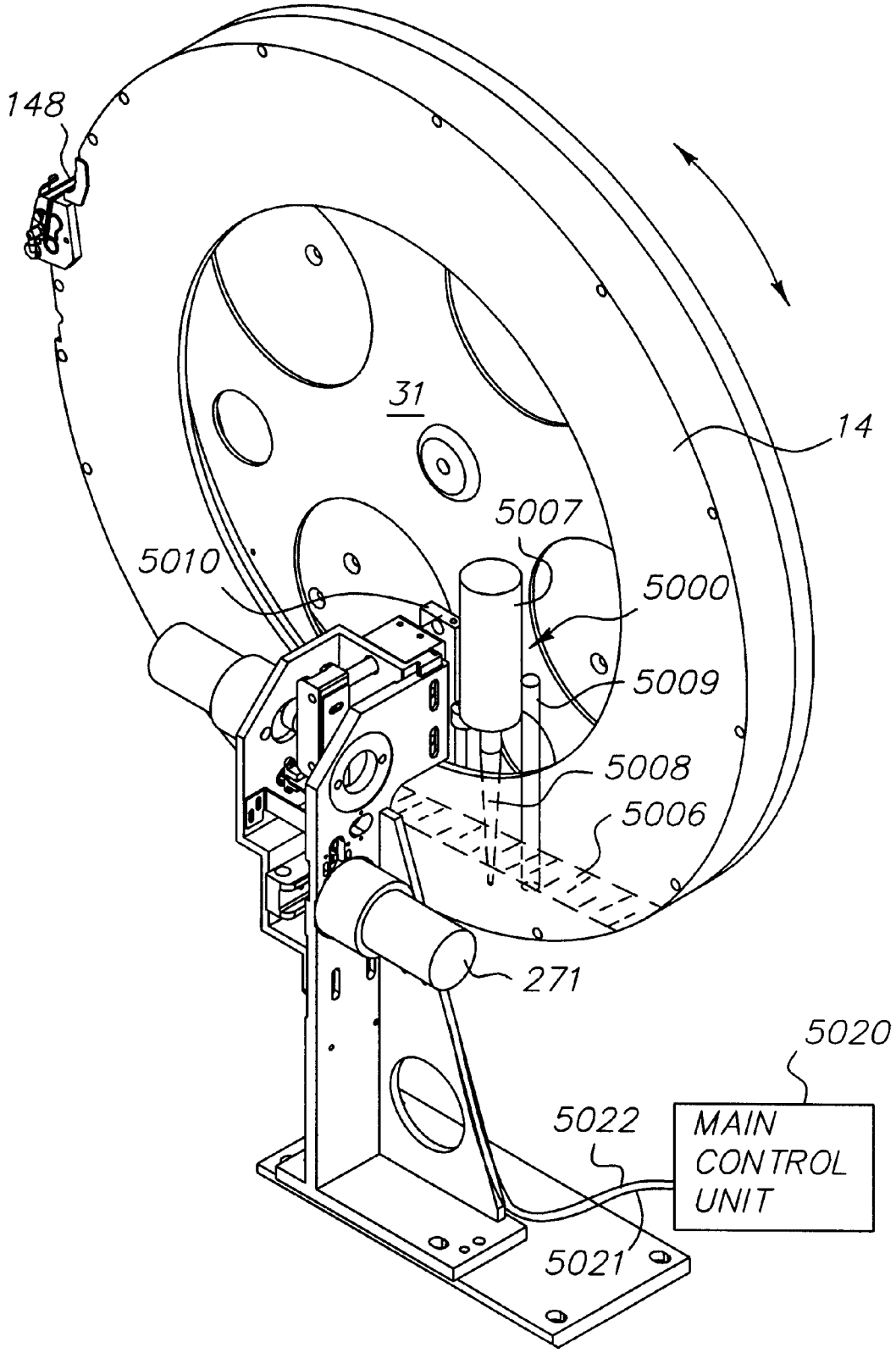
FIG. 22 is a perspective view of a photographic processor having a cleaning arrangement in accordance with the present invention.

FIG. 22 is a schematic view of processing drum or chamber 14 having a cleaning arrangement 5000 in accordance with the present invention. As previously described, in processing drum 14 photographic material, i.e. sensitized media, is mechanically loaded into drum 14 through slot 148. The media is loaded with the sensitized emulsions facing up and appropriate amount of chemical solutions are then delivered into circular processing drum 14 through appropriate fluid handling systems as also previously described. Drum 14 can be heated by appropriate means (not shown) and rotated on its axis during processing or reaction as also previously described. During processing, several parts of the processor can be submerged in processing solution at any time in order to provide agitation of the solutions (for example, roller 270), heating of the solutions or removal of the solutions. The positioning of these parts (for example, roller 270) can be accomplished by use of motor 271. At the end of a process, the chemical or processing solutions are removed through appropriate fluid handling means and a cleaning solution can be used to rinse desensitized media in the processing drum. Depending on the efficiency of the processing solution removal, there may be small amounts of processing solution remaining in the processing drum that can introduce contamination to the next processing cycle or even turn the processing drum surface into a sticky surface which hampers the loading of the next roll of sensitized media. Chemicals that are not drained properly will also lead to fouling and eventual malfunction of other mechanical parts or components in circular processing drum 14. This can lead not only to image quality loss but also to a catastrophic failure of the equipment.

The surfaces of circular processing drum 14 and other components of the photographic processor could be cleaned manually by a service person or a skilled employee, however, it is desired that the cleaning method be in the form of an automatic cycle that could be accomplished without a skilled operator. An automated cleaning cycle is also desirable in order to minimize the contact of the equipment operator with chemicals.

As shown in FIG. 22, cleaning arrangement 5000 defines a transducer and probe assembly which includes a stationary or movable transducer 5007 equipped with a probe 5008. The combination of transducer 5007 and probe 5008 are adapted to disperse energy in order to generate ultrasonic energy in a cleaning solution as necessary. More specifically, as shown in FIG. 22, processing drum or chamber 14 is designed to hold processing solution within the drum during processing. In a cleaning cycle, the processing solution is discarded and a cleaning solution is applied to processing drum 14.

As shown in FIG. 22, transducer 5008 and probe 5007 could be mounted on a movable assembly or platform 5010 that positions transducer 5007 and probe 5008 and also operates other devices such as agitation devices in drum 14. Movable assembly 5010 can be positioned by means of motor 271 or a dedicated motor. Motor 271 or the dedicated motor could be operationally associated with a gear train, a pneumatic piston arrangement, a cam, etc., for moving transducer 5007 and probe 5008 in a manner which will be described.

Cleaning arrangement 5000 of the present invention can also include an optional fluid level sensor 5009 that is used to assure that there is an appropriate level of cleaning solution 5006 in processing drum 14. Fluid level detection (usually by contact or optionally by a remote sensor which does not contact the fluid) can be done by several methods: float switches are very common in the industry, but tend to be bulky. Electro-optic switches (based on refraction of infrared light in liquid), ultrasonic switches (based on propagation of sound waves in liquid), or conductivity switches as described in U.S. Pat. No. 6,364,545 can also be used. In FIG. 22, reference numeral 5009 schematically illustrates the level monitoring feature. Since space is an issue, conductivity probes and electro-optic switches are the least bulky and more appropriate for use in this context. Other methods for fluid level sensing that are known in the field can also be used and therefore, the invention is not limited by such implementations. Therefore, fluid level sensor 5009 is used to ensure that the appropriate level of cleaning solution 5006 has been delivered before ultrasonic energy is generated by cleaning arrangement 5000.

As shown in FIG. 22, a control unit 5020 can be used to control the positioning of transducer 5007 and probe 5008, as well as receive signals from fluid level sensor 5009. More specifically, control unit 5020 which could be integrated with CPU 2000, the same as CPU 2000 or separate from CPU 2000 can receive and send signals to and from transducer 5007 by way of a communication line 5021, and can also receive and send signals to and from level sensor 5009 by way of a communication line 5022.

During use of processing drum 14 having cleaning member 5000 as described, the processor will go through it normal processing cycles to process photographic material. When it is desired to activate or initiate a cleaning cycle or stage, control unit 5020 provides a signal to motor 271 and/or transducer 5007 to lower probe 5008 to a predetermined height above an inner surface of circular processing drum 14. Cleaning solution or water that is preheated in a known manner or at ambient temperature is delivered to fill drum 14 to a predetermined level such that probe 5008 contacts the cleaning solution. When the appropriate amount of cleaning solution or water has been delivered (for example, as measured by level sensor 5009), circular processing drum 14 starts rotating slowly while probe 5008 through transducer 5007 provides an ultrasonic cleaning action to the cleaning solution. It is noted the processing drum 14 is rotated in the manner as described in FIGS. 8, 9A and 9B and can be relatively rotated in a continuous or intermittent manner.

Figure 23:
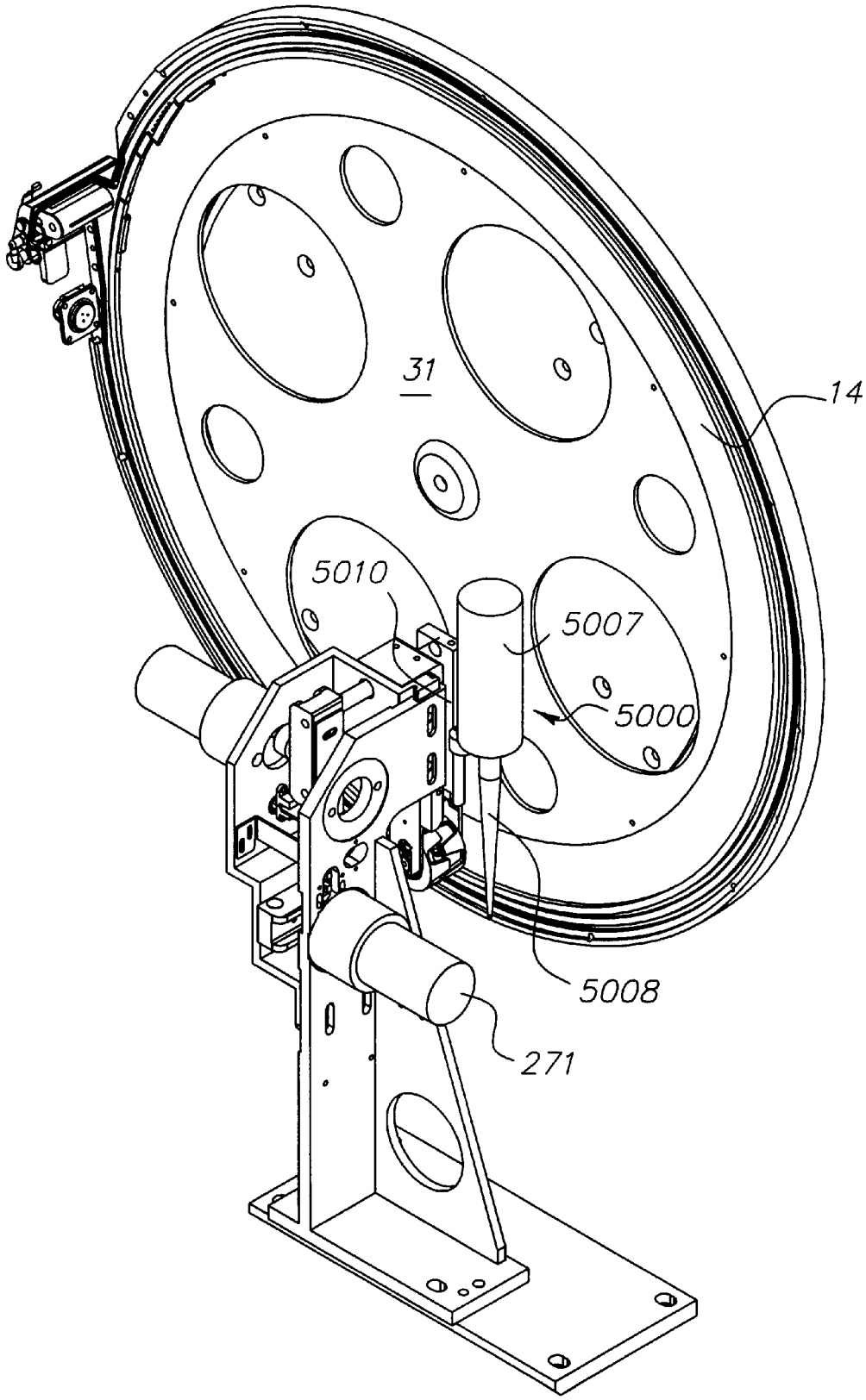
FIG. 23 is a view of the processor and cleaning arrangement of the present invention, wherein an ultrasonic probe of the cleaning arrangement is shown in a lowered position for cleaning.

FIG. 23 shows probe 5008 and transducer 5007 in a lowered position during a cleaning cycle or stage. Thus, when cleaning solution is supplied to processing drum 114 and probe 5008 is lowered so as to contact the cleaning solution, transducer 5007 is activated so as to provide ultrasonic energy to the cleaning solution via the probe 5008. A rotation of circular processing drum 14 while the ultrasonic energy is being applied to the cleaning solution assures that all sections or components of circular processing drum 14 will be cleaned by way of the ultrasonic action in the cleaning solution generated by probe 5008.

Figure 24:
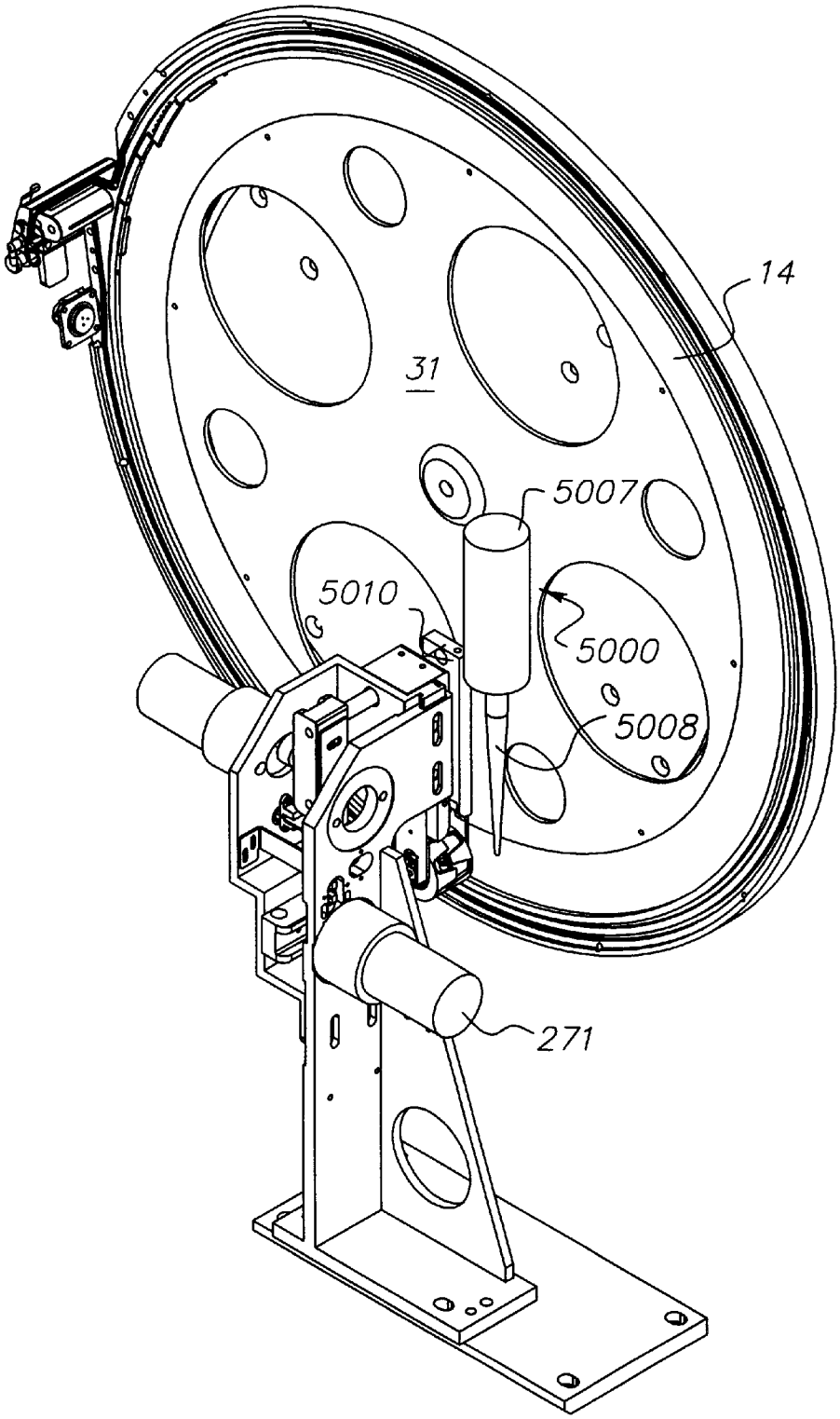
FIG. 24 is a view of the processor and cleaning arrangement of FIG. 23, with the probe being in a raised non-cleaning position.
Figure 25:
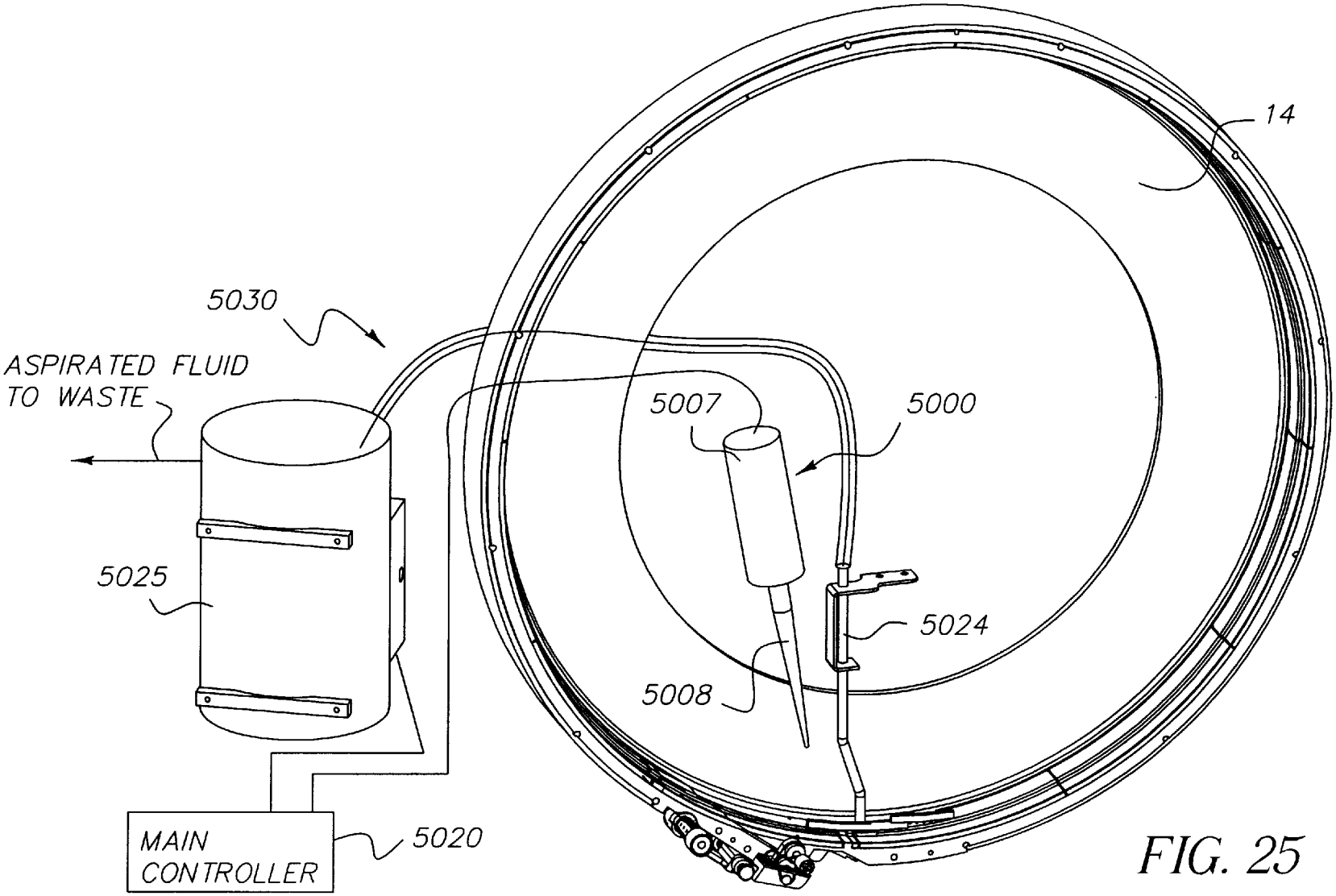
FIG. 25 is a view of the processor and cleaning arrangement, wherein an aspirator is shown.

Upon completion of the cleaning cycle or stage, probe 5008 is removed from contact with the cleaning solution as shown in FIG. 24. Also upon completion of the cleaning cycle or stage, the cleaning solution will contain soils that can be aspirated/removed from processing drum 14. FIG. 25 shows an aspirator arrangement 5030 which can be used to achieve the removal of the soil containing cleaning solution. More specifically, as shown in FIG. 25, upon completion of the cleaning cycle or stage, an aspirator 5024 and a pump 5025 are activated by way of control unit 5020. Aspirator 5024 in combination with pump 5025 are used to suck up the soiled cleaning solution and pump the soiled cleaning solution to an appropriate waste disposal. Upon completion of this cleaning cycle, additional cleaning cycles can be used to remove any remaining soils. The selfcleaning cycle for the noted photographic processor can be operated using a recycled or replenished supply of cleaning solution or water for any of the cleaning steps involved, especially the first cleaning step where most of the deposits are removed. Progressively cleaner solutions or water can be used for subsequent steps.

The use of cleaning arrangement 5000 and more specifically, transducer 5007 and probe 5008 in a cleaning cycle which provides ultrasonic energy to the cleaning solution could be activated as needed in order avoid image quality loss. In order not to interfere with normal business hours, the cleaning cycle or stage could be programmed and automatically activated by control unit 5020 at shut down of the photographic processor or at regular intervals. To prevent equipment damage, appropriate sensors can be used so that if there is not enough solution to complete a cleaning cycle, control unit 5020 can cancel the activation of the cleaning cycle. Further, control unit 5020 can control the length of time that the ultrasonic energy is applied, and can control cleaning arrangement 5000 based on the amount of soil within drum 14.

Therefore, the present invention provides for a system and method for providing an automated cleaning cycle in a batch photographic processor. The system and method of the present invention overcomes common soil problems in batch processors that results in image quality loss (contamination) or catastrophic failure (a tear during the loading of photographic film). Transducer 5007 and ultrasonic probe 5008 are preferably integrated and provided in the processor. Probe 5008 could be stationary or mobile. During a cleaning cycle stage, the photographic processor and specifically drum 14 can be rotated very slowly or intermittently to allow enough energy to be delivered. The cleaning cycle or stage can be activated on demand or in planned intervals and does not require operator intervention or operator handling of any chemicals. The cleaning cycle or stage can also use recycled or replenished cleaning solution or water for higher efficiency. Further, the cleaning solution or water can be delivered at room temperature or be preheated. Liquid level sensor 5009 can be used to confirm the presence of adequate cleaning solution in processing drum 14 before ultrasonic probe 5008 is activated, to avoid damaging the probe tip.

As previously described, the drum can be rotated relative to the disk or the disk and drum can be rotated together during a cleaning cycle to enhance the cleaning operation. Additionally, control unit 5020 in combination with motor 271 can be used to move transducer 5007 and probe 5008 between a non-cleaning inactive position as shown in FIG. 24 where probe 5008 is removed from the cleaning solution, and a cleaning active position as shown in FIG. 23 where probe 5008 contacts the cleaning solution. Control unit 5020 can be used to automatically control the cleaning operation such that it can occur during shut down times of the processor or at intermittent times. Thus, with the use of control unit 5020, transducer 5007 and probe 5008 can be controlled so as to be selectively activated during a cleaning cycle or stage and deactivated during a non-cleaning cycle or stage.

Although the cleaning arrangement of the present invention has been described as being used with a batch processor having a circular processing drum with a disk, the present invention is not limited to such a processor. It is recognized that the present invention is applicable to any photographic processor which is subject to soiling of the components of the processor due to the processing of photographic material.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

The invention has been described in detail with particular reference to certain preferred embodiments thereof, but it will be understood that variations and modifications can be effected within the spirit and scope of the invention.

What is claimed is:

1. A photographic processor comprising:

a circular processing drum for processing photographic film;

a disk positioned inside the drum and having one or more sets of disk teeth along an outer perimeter of the disk, said disk teeth being capable of interengaging with holes along an edge of photographic film to be processed to transport the photographic film along a film path in said processing drum; and a cleaning arrangement comprising a transducer and a probe, said transducer and said probe being adapted to provide ultrasonic energy to a cleaning solution provided in said processing drum during a cleaning stage of the photographic processor to clean components of said photographic processor.

2. A photographic processor according to claim 1, further comprising a mechanism adapted to rotate the disk while the drum is stationary.

3. A photographic processor according to claim 2, wherein said mechanism is further adapted to rotate the disk and the drum simultaneously.

4. A photographic processor according to claim 1, wherein said a probe is adapted to contact the cleaning solution to provide the ultrasonic energy to the cleaning solution.

5. A photographic processor according to claim 4, further comprising a motor for moving said probe between a non-cleaning inactive position in which said probe is removed from the cleaning solution and a cleaning active position in which said probe contacts said cleaning solution.

6. A photographic processor according to claim 1, further comprising a controller for automatically controlling operation of said transducer and said probe during said cleaning stage.

7. A photographic processor according to claim 1, further comprising a sensor which is adapted to detect a cleaning solution level in said drum.

8. A photographic processor according to claim 1, wherein said cleaning solution comprises recycled water.

9. A photographic processor according to claim 1, wherein said cleaning solution comprises heated water.

10. A photographic processing apparatus for processing photographic media, the processing apparatus comprising:

a processing chamber for processing photographic media; and a cleaning arrangement comprising a transducer and a probe, said transducer and said probe being adapted to impart ultrasonic energy to cleaning solution provided in said processing chamber during a cleaning stage of said photographic processing apparatus.

11. A photographic processing apparatus according to claim 10, wherein said photographic processing apparatus is a batch processor.

12. A photographic processing apparatus according to claim 10, wherein said probe is adapted to contact the cleaning solution to provide the ultrasonic energy to the cleaning solution.

13. A photographic processing apparatus according to claim 12, further comprising a motor for moving said probe between a non-cleaning inactive position in which said probe is removed from the cleaning solution and a cleaning active position in which said probe contacts said cleaning solution.

14. A photographic processor according to claim 10, further comprising a controller for automatically controlling operation of said transducer and said probe during said cleaning stage.

15. A photographic processor according to claim 10, further comprising a sensor which is adapted to detect a level of cleaning solution in said chamber.

16. A photographic processing apparatus according to claim 10, wherein said cleaning solution comprises recycled water.

17. A photographic processing apparatus according to claim 10, wherein said cleaning solution comprises heated water.

18. A method of operating a photographic processor to process photographic media, the method comprising the steps of:

inserting photographic media into a circular processing drum;

supplying and discharging processing solution into and from said processing drum during a processing stage to process the photographic media;

supplying a cleaning solution to the processing drum during a cleaning stage;

contacting said cleaning solution with an ultrasonic probe; and selectively activating said ultrasonic probe in contact with said cleaning solution to impart ultrasonic energy to said cleaning solution and clean components of the photographic processor.

19. A method according to claim 18, comprising the step of:

continuously rotating said processing drum during said cleaning stage.

20. A method according to claim 18, comprising the further step of:

intermittently rotating said processing drum during said cleaning stage.

21. A method according to claim 18, wherein said contacting step comprises moving said probe from an inactive position during a non-cleaning stage or said processing stage in which said transducer is removed from said cleaning solution, to an active position during said cleaning stage in which said probe contacts said cleaning solution.

22. A method of cleaning a photographic processor, the method comprising the steps of:

supplying a cleaning solution in said processor chamber;

contacting said cleaning solution with an ultrasonic probe; and selectively activating said probe in contact with said cleaning solution to impart an ultrasonic energy to said cleaning solution and clean components of the photographic processor.

23. A method according to claim 22, wherein said contacting step comprises moving said probe from an inactive position during a non-cleaning stage in which said probe is removed from said cleaning solution, to an active position during a cleaning stage in which said probe contacts said cleaning solution.

* * * * *